US012274363B2

(12) United States Patent
Chumakov

(10) Patent No.: US 12,274,363 B2
(45) Date of Patent: Apr. 15, 2025

(54) ADJUSTABLE HEIGHT TABLE AND BASE ASSEMBLY

(71) Applicant: Humanscale Corporation, New York, NY (US)

(72) Inventor: Vladimir Chumakov, Brooklyn, NY (US)

(73) Assignee: Humanscale Corporation, New York, NY (US)

( * ) Notice: Subject to any disclaimer, the term of this patent is extended or adjusted under 35 U.S.C. 154(b) by 0 days.

(21) Appl. No.: 18/094,070

(22) Filed: Jan. 6, 2023

(65) Prior Publication Data

US 2023/0218076 A1 Jul. 13, 2023

Related U.S. Application Data

(60) Provisional application No. 63/419,807, filed on Oct. 27, 2022, provisional application No. 63/297,405, filed on Jan. 7, 2022.

(51) Int. Cl.
*A47B 9/06* (2006.01)
*A47B 9/02* (2006.01)

(52) U.S. Cl.
CPC ..... *A47B 9/06* (2013.01); *A47B 9/02* (2013.01); *A47B 2009/065* (2013.01); *A47B 2200/0058* (2013.01)

(58) Field of Classification Search
CPC .... A47B 9/06; A47B 9/02; A47B 9/20; A47B 2009/065; A47B 2200/0058
See application file for complete search history.

(56) References Cited

U.S. PATENT DOCUMENTS 3,140,559 A * 7/1964 Grow ..... A47B 27/06 108/6
5,408,940 A * 4/1995 Winchell ..... A47B 9/06 108/147

(Continued)

FOREIGN PATENT DOCUMENTS

WO 2016195853 12/2016
WO 2017053200 3/2017

OTHER PUBLICATIONS

International Search Report and Written Opinion dated Apr. 5, 2023, from Applicant's counterpart International Patent Application No. PCT/US2023/10308.

*Primary Examiner* — Daniel J Rohrhoff
(74) *Attorney, Agent, or Firm* — Jones Walker LLP

(57) ABSTRACT

An adjustable height table base assembly includes two or more leg assemblies each including a mobile leg member, a stationary leg member, and a linear motion system. The mobile and stationary leg members are each formed of a flat vertical support structure. The leg assemblies are configured to extend and retract to adjust a height position of the mobile leg member and any table top secured to the mobile leg member. The mobile leg members slide in a parallel direction in relation to the stationary leg members by means of linear motion systems. The power mechanism for the adjustable height table may comprise a counterbalance mechanism or one or more electric motors. Optionally, each of the leg assemblies also includes a non-load bearing cover enclosing at least a portion of the mobile leg member and at least a portion of the stationary leg member.

18 Claims, 25 Drawing Sheets

(56) References Cited

U.S. PATENT DOCUMENTS

| | | | | |
|---|---|---|---|---|
| 5,706,739 | A * | 1/1998 | Shaheen | A47B 9/02 248/162.1 |
| 6,584,917 | B2 * | 7/2003 | Long | A47B 9/00 108/147 |
| 7,252,277 | B2 | 8/2007 | Sweere et al. | |
| 8,826,831 | B2 | 9/2014 | Hazzard et al. | |
| 8,839,723 | B2 | 9/2014 | Hazzard et al. | |
| 8,925,154 | B2 | 1/2015 | Ergun | |
| 9,038,549 | B1 | 5/2015 | Zebarjad | |
| 9,080,721 | B2 | 7/2015 | Hazzard et al. | |
| 9,188,275 | B2 | 11/2015 | Ergun et al. | |
| 9,267,639 | B2 | 2/2016 | Sweere et al. | |
| 9,332,836 | B1 | 5/2016 | Zebarjad | |
| 9,360,152 | B2 | 6/2016 | Sweere et al. | |
| 9,371,955 | B2 | 6/2016 | Fu et al. | |
| D769,881 | S | 10/2016 | Lazzi et al. | |
| 9,510,670 | B2 * | 12/2016 | Zebarjad | A47B 9/20 |
| 9,572,422 | B2 | 2/2017 | Ergun et al. | |
| 9,581,285 | B2 | 2/2017 | Ergun et al. | |
| 9,668,572 | B2 | 6/2017 | Ergun et al. | |
| 9,687,073 | B2 | 6/2017 | Sweere et al. | |
| 9,700,136 | B1 | 7/2017 | Zebarjad | |
| 9,717,329 | B2 | 8/2017 | Hazzard et al. | |
| 9,820,566 | B2 | 11/2017 | Hazzard et al. | |
| D812,066 | S | 3/2018 | Lazzi et al. | |
| 9,961,992 | B2 | 5/2018 | King et al. | |
| 10,034,538 | B1 * | 7/2018 | Masters | B25H 1/16 |
| 10,104,957 | B2 | 10/2018 | Ergun et al. | |
| D849,456 | S | 5/2019 | Chumakov et al. | |
| 10,321,755 | B1 * | 6/2019 | Sie | A47B 9/06 |
| 10,426,260 | B2 | 10/2019 | Benden | |
| 10,555,602 | B1 * | 2/2020 | Lu | A47B 9/04 |
| 10,667,602 | B2 | 6/2020 | Hazzard et al. | |
| D910,343 | S | 2/2021 | Chumakov et al. | |
| 10,918,202 | B1 * | 2/2021 | Sie | A47B 9/06 |
| 2001/0035704 | A1 * | 11/2001 | Dierbeck | F16C 29/048 384/19 |
| 2016/0095425 | A1 * | 4/2016 | Yang | A47B 9/06 248/188.2 |
| 2018/0317645 | A1 * | 11/2018 | Stoelinga | A47B 9/12 |
| 2020/0337451 | A1 * | 10/2020 | Tao | A47B 9/12 |

* cited by examiner

ADJUSTABLE HEIGHT TABLE AND BASE ASSEMBLY

CROSS-REFERENCE TO RELATED APPLICATIONS

This application claims the benefit of and priority to U.S. Provisional Patent Application No. 63/297,405, filed on Jan. 7, 2022, and U.S. Provisional Patent Application No. 63/419,807, filed on Oct. 27, 2022, each of which is incorporated herein by reference in its entirety.

BACKGROUND OF THE INVENTION

Adjustable height tables have been developed to allow users to change posture from a seated position to a standing position throughout the day. Existing adjustable height tables typically utilize either a hand crank, an electric motor, or a counterbalance mechanism to adjust the height of the table top. Counterbalance adjustable tables utilize either a counterweight or a spring to offset the load on the table top. Existing adjustable height tables have telescoping legs formed of multiple leg segments that retract within each other.

SUMMARY OF THE INVENTION

The present invention comprises a base assembly for an adjustable height table with two or more leg assemblies, each including flat vertical support structures that slide past one other, providing aesthetic benefits, increasing privacy and ease of assembly, and reducing manufacturing costs. As a result, tables practicing the current invention are suitable for a more diverse range of environments (e.g., office, home, school) and are more affordable to consumers, permitting broader enjoyment of their ergonomic benefits. The present invention permits the use of nontraditional materials for an adjustable height desk such as veneer and laminate, or softer materials like PET or mesh, as opposed to typical steel tube construction.

An adjustable height table base assembly includes two or more leg assemblies each including a mobile leg member, a stationary leg member, and a linear motion system. The mobile leg member is configured to be secured to and support a table top. The mobile leg member has a height position that is adjustable between a lowered position and a raised position for adjusting a height position of a table top that is secured thereto. The mobile leg members and the stationary leg members are each formed of a flat vertical support structure. The leg assemblies are configured to extend and retract to adjust the height position of the mobile leg members. The mobile leg members slide past the stationary leg members by means of the linear motion systems positioned parallel to the leg members. The resulting configuration permits the mobile leg members to slide past the stationary leg members in a vertical linear direction parallel to the stationary leg members. In other words, the linear motion systems permit vertical parallel motion of the mobile leg members in relation to the stationary leg members for extending and retracting the leg assemblies to adjust the height position of the mobile leg members.

The mobile leg members may be located on the exterior or interior of the stationary leg members relative to the overall base assembly. Each linear motion system includes a first portion secured to the mobile leg member and a second portion secured to the stationary leg member. In some embodiments, the linear motion systems comprise rails, sliding or rolling members, drawer slides, linear glides, glides, rollers, racks and gears, or custom sliders. The base assembly may further include a bridge extending between and interconnecting the two or more leg assemblies. In certain embodiments, the bridge includes an axle and a housing each extending between the two or more leg assemblies, with the axle disposed within the housing. The base assembly may further include two rack and pinion assemblies each including a pinion secured to the axle, such as an end of the axle, and a rack secured to either the mobile leg member or the stationary leg member of one of the leg assemblies. In certain embodiments, each rack and pinion assembly is positioned within a central portion of the stationary leg member and the mobile leg member. A synchronizing system of the base assembly may be configured to maintain a level orientation of each mobile leg member during adjustment of the mobile leg member's height position. In certain embodiments, the synchronizing system includes a flexible line. The base assembly may further comprise a counterbalance mechanism, a single electric motor, or two electric motors. In some embodiments, non-load bearing covers may be configured to enclose at least a portion of the mobile leg members and at least a portion of the stationary leg members, such as the sliding connections between the mobile leg members and the stationary leg members.

In some embodiments, the adjustable height table base assembly includes a counterbalance mechanism that applies an equalized counterbalance lifting force as the mobile leg members' height position is adjusted. In certain embodiments, the counterbalance mechanism includes an axle extending between the two or more leg assemblies, two rack and pinion assemblies, a spring tensioner, a spool, a torsion spring, a rope drum, and a lift rope. Each pinion of the rack and pinion assemblies is rotationally secured to an end of the axle and configured to engage and rotate on one of the racks. The spring tension includes a threaded outer portion and a central bore, with the axle disposed through the central bore. The spring tensioner does not rotate when the height position of the mobile leg members is adjusted. The spool includes a variable cam track and a threaded central bore. The threaded outer portion of the spring tensioner is disposed through the threaded central bore of the spool. The spool is configured to rotate on the spring tensioner as the height position is adjusted. The torsion spring is disposed around a central portion of the axle. A first end of the torsion spring engages the spool, which is configured to twist the torsion spring as the spool rotates on the spring tensioner to adjust a torque exerted by the torsion spring on the spool. The rope drum is rotationally secured around the axle. The lift rope extends from a rope track of the rope drum to the variable cam track of the spool. The variable cam track provides a variable lever arm to equalize the counterbalance lifting force as the torque exerted by the torsion spring varies with the adjustment of the height position.

In this embodiment, adjustment of the height position may rotate the two pinions, the axle, and the rope drum to wind or unwind the lift rope on the rope track of the rope drum and to unwind or wind the lift rope on the variable cam track of the spool for twisting the first end of the torsion spring. The counterbalance mechanism may further include a series of pulleys configured to engage and direct the lift rope between the variable cam track of the spool and the rope track of the rope drum. The spool may move in an axial direction in relation to the axle to align the point at which the lift rope departs from the variable cam track of the spool with a fixed pulley. The second end of the torsion spring may engage a spring hub, which may be disposed around the axle.

In some embodiments, the adjustable height table base assembly also includes a brake mechanism configured to prevent height adjustment in a locked position and to allow height adjustment in a released position. The brake mechanism may include a spur gear rotationally secured to the axle, a latch biased to engage teeth of the spur gear to prevent rotation of the spur gear and the axle in the locked position, and a brake cable extending from a brake release control to the latch. Activating the brake release control may withdraw the latch from the teeth of the spur gear to allow rotation of the spur gear and the axle in the released position.

In certain embodiments, the adjustable height table base assembly may further include a force adjustment mechanism for selectively adjusting the torque exerted by the torsion spring at each height position of the mobile leg members. The force adjustment mechanism may include a spring hub disposed around the central portion of the axle, a worm gear rotationally secured to the spring hub, a worm, and a charge handle rotationally coupled to the worm. In this embodiment, a second end of the torsion spring engages the spring hub for selectively twisting the second end of the torsion spring. The worm gear includes a plurality of teeth and a central bore. The worm includes a threaded surface engaging at least a portion of the plurality of teeth of the worm gear. Rotating the charge handle rotates the worm, the worm gear, and the spring hub to twist the second end of the torsion spring to adjust the torque exerted by the torsion spring and the equalized counterbalance lifting force exerted by the counterbalance mechanism at each height position. The force adjustment mechanism may further include a charge indicator.

In certain embodiments, the force adjustment mechanism may further include a charge control screw rotationally secured to the spring hub and a charge control mechanism. The charge control screw includes a threaded outer portion and a central bore, with the axle disposed through the central bore. The charge control mechanism includes a threaded bore. The threaded outer portion of the charge control screw is disposed through the threaded bore of the charge control mechanism. The charge control mechanism is configured to limit a magnitude of the adjustment to the torque exerted by the torsion spring caused by rotation of the charge handle. The charge control mechanism may limit the magnitude of the adjustment to the torque exerted by the torsion spring by limiting the rotation of the charge control screw. The charge control mechanism may further include a charge control drum rotationally secured to a charge control shoe. The charge control shoe may be configured to allow sliding and to prevent rotation of the charge control mechanism relative to a housing. The threaded bore of the charge control mechanism is formed by a threaded bore of the charge control drum.

Alternatively, the load exerted by the counterbalance mechanism may be fixed during manufacturing resulting in a fixed-force counterbalance table base assembly.

In some embodiments, the counterbalance mechanism of the adjustable height table base assembly includes an axle extending between the two or more leg assemblies, two rack and pinion assemblies secured to the ends of the axle, a torsion spring disposed around a central portion of the axle, and an equalizing assembly engaging the axle and one end of the torsion spring. The equalizing assembly twists the torsion spring as the axle rotates with adjustment of the height position of the mobile leg members. The equalizing assembly is configured to translate the variable torque exerted by the torsion spring on the equalizing assembly into the equalized counterbalance lifting force exerted by the equalizing assembly on the two rack and pinion assemblies. In some embodiments, the equalizing assembly includes a variable lever arm for equalizing the counterbalance force as the torque exerted by the torsion spring varies with adjustment of the height position. In certain embodiments, the equalizing assembly includes a spring tensioner, a spool, a rope drum, and a lift rope. In this embodiment, a variable cam track of the spool provides the variable lever arm.

A kit may include any of the disclosed embodiments of the adjustable height table base assembly and a table top configured for attachment to the mobile leg members of the base assembly.

An adjustable height table may include any of the disclosed embodiments of the adjustable height table base assembly and a table top secured to and supported by the mobile leg members. The table top may have a height position that is adjustable between a lowered position and a raised position.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages in accordance with the present invention.

DETAILED DESCRIPTION OF SELECTED EMBODIMENTS

Figure 1:
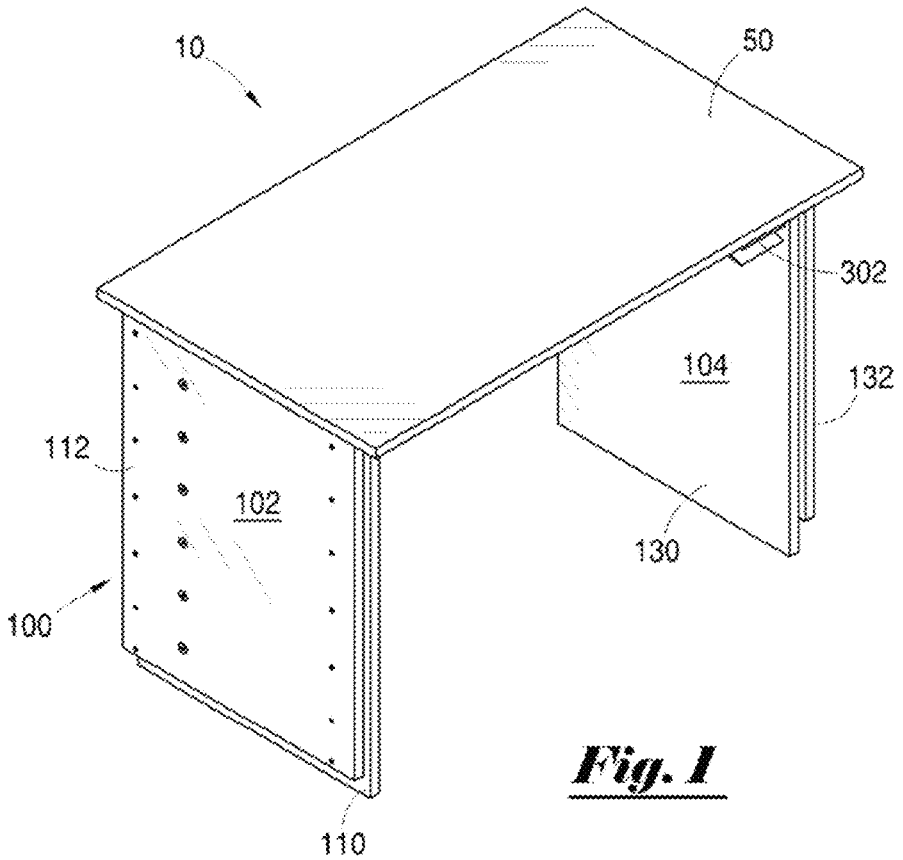
FIG. 1 is a perspective view of an embodiment of an adjustable height table exemplifying the principles of the present invention with the table in a lowered position.
Figure 2:
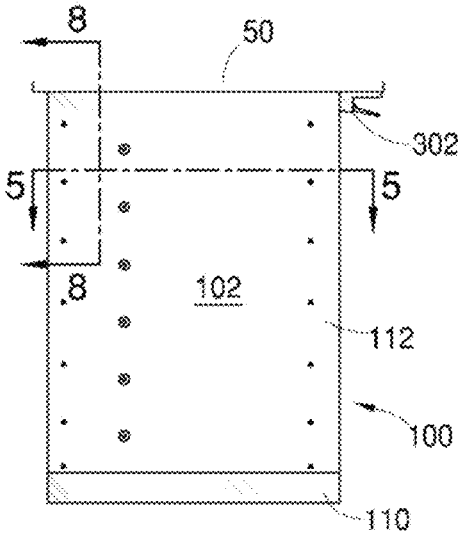
FIG. 2 is a side view of the embodiment of the adjustable height table shown in FIG. 1 with the table in the lowered position.
Figure 3:
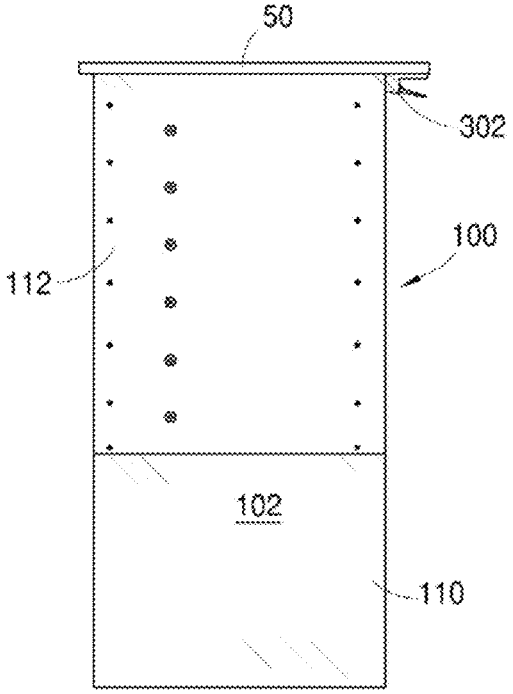
FIG. 3 is a side view of the embodiment of the adjustable height table shown in FIG. 1 with the table in a raised position.

Detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. Various embodiments of the present invention are described herein. To avoid redundancy, repetitive description of similar features may not be made in some circumstances.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Any range of numeric values disclosed herein includes any subrange therein. Relational terms such as first and second, top and bottom, right and left, and the like may be used solely to distinguish one entity or action from another entity or action without necessarily requiring or implying any actual such relationship or order between such entities or actions.

Disclosed herein is an adjustable height table including a table top and two or more leg assemblies supporting the table top. Each leg assembly includes a mobile leg member slidingly coupled to a stationary leg member. The mobile and stationary leg members are formed of flat vertical support members. In some embodiments, the mobile and stationary leg members are separated by a leg space. A linear motion system is secured to the mobile and stationary leg members. Portions of the linear motion system engage as the table's height position is adjusted, permitting the mobile leg member to slide parallel to the stationary leg member in a vertical linear motion. The linear motion system may comprise rails, drawer slides, linear glides, glides, rollers, racks and gears, or custom sliders. Adjustable height tables embodying the principles of the present invention are depicted in FIGS. 1-26.

Referring now to FIGS. 1-4, adjustable height table 10 may include a table top 50 supported by base assembly 100. Base assembly 100 may include first leg assembly 102, second leg assembly 104, and a bridge extending from first leg assembly 102 to second leg assembly 104. In the illustrated embodiment, the bridge may include housing 106 and certain components contained within housing 106. In other embodiments, the bridge may include a modesty panel or any other structure interconnecting the leg assemblies. First and second leg assemblies 102 and 104 may each be configured to extend and retract to adjust a height position of table 10 between a lowered position shown in FIG. 2 and a raised position shown in FIG. 3. First and second leg assemblies 102 and 104 may be connected to table top 50 near edges of table top 50 to maximize leg room when a user is seated with table 10 in the lowered position. Similarly, housing 106 may be positioned near one end of table 10 and leg assemblies 102 and 104 to maximize leg room for a seater user with table 10 in the lowered position.

Housing 106 may contain at least a portion of a counterbalance mechanism, a brake mechanism, and a force adjustment mechanism. The counterbalance mechanism is configured to apply an equalized counterbalance lifting force as the height position of table top 50 is adjusted as first and second leg assemblies 102 and 104 extend and retract. The brake mechanism is configured to prevent movement of leg assemblies 102, 104 in a locked position and to allow movement of leg assemblies 102, 104 in a released position. The force adjustment mechanism is configured to adjust a charge of the counterbalance mechanism to increase or decrease the equalized counterbalance lifting force, which is useful when items of varying weights are supported by table top 50.

Referring now to FIGS. 1-5, first leg assembly 102 may include first stationary leg member 110 coupled to first mobile leg member 112. First stationary leg member 110 may contact a floor, while first mobile leg member 112 is secured to a lower side 52 of table top 50. First leg space 114 (shown in FIG. 5) may be defined between first stationary leg member 110 and first mobile leg member 112. In the illustrated embodiment, one or more components 116 and 118 of a first linear motion system may be secured between first stationary leg member 110 and first mobile leg member 112 in first leg space 114. In other embodiments, components 116 and 118 of the first linear motion system may not be disposed in first leg space 114. The linear motion system with components 116 and 118 may be formed of rails, drawer slides, linear glides, glides, rollers, racks and gears, custom sliders, or any other device configured to provide a reduced friction and smooth sliding motion between the mobile and stationary leg members. For example, but not by way of limitation, components 116, 118, and 120 of the linear motion system may be constructed as a single unit. Linear motion system components 116 and 118 may be engaged to allow first mobile leg member 112 to move vertically relative to first stationary leg member 110 as table top 50 is adjusted between the lowered position shown in FIGS. 1 and 2 and the raised position shown in FIG. 3. For example, but not by way of limitation, component 116 may slide within component 118. The counterbalance mechanism may alternatively be connected to either stationary leg member 110 or mobile leg member 112. If connected to the mobile leg member, the counterbalance mechanism may also be connected to the table top.

Similarly, second leg assembly 104 may include second stationary leg member 130 coupled to second mobile leg member 132. Second stationary leg member 130 may contact a floor, while second mobile leg member 132 is secured to the lower side 52 of table top 50. Second leg space 134 (shown in FIG. 5) may be defined between second stationary leg member 130 and second mobile leg member 132. In the illustrated embodiment, one or more components 136 and 138 of a second linear motion system may be secured between second stationary leg member 130 and second mobile leg member 132 in the second leg space 134. In other embodiments, components 136 and 138 of the second linear motion system may not be disposed in second leg space 134. The linear motion system with components 136 and 138 may be formed of rails, drawer slides, linear glides, glides, rollers, racks and gears, custom sliders, or any other device configured to provide a reduced friction and smooth sliding motion between the mobile and stationary leg members. For example, but not by way of limitation, components 136, 138, and 140 of the linear motion system may be constructed as a single unit. Linear motion system components 136 and 138 may be engaged to allow second mobile leg member 132 to move vertically relative to second stationary leg member 130 as table top 50 is adjusted between the lowered position shown in FIGS. 1 and 2 and the raised position shown in FIG. 3. For example, but not by way of limitation, component 136 may slide within component 138. The counterbalance mechanism may alternatively be connected to either stationary leg member 130 or mobile leg member 132. If connected to the mobile leg member, the counterbalance mechanism may also be connected to the table top.

In certain embodiments, adjustable height table 10 may include no leg spaces between the stationary and mobile leg members of each leg assembly.

In certain embodiments, the stationary leg members 110 and 130 and the mobile leg members 112 and 132 of the first and second leg assemblies 102 and 104 may each be formed of an elongated generally flat panel. In some embodiments, the width of each stationary leg member and/or each mobile leg member may be similar or nearly similar to the width of table top 50. For example, the width of the leg members may be about 50% to about 100% of the width of the table top. Alternatively, the width of the leg members may be about 60% to about 80% of the width of the table top.

In select embodiments, the first and second leg assemblies 102 and 104 may each include a shell that partially or completely encloses the stationary and mobile leg members.

In certain embodiments, housing 106 is secured to stationary leg members 110 and 130, such that housing 106 remains stationary as the height position of table top 50 is adjusted. This configuration reduces the weight that is required to be lifted when the height position of the table top 50 is adjusted. The lower weight requires less effort to adjust the height position of table 10.

Figure 4:
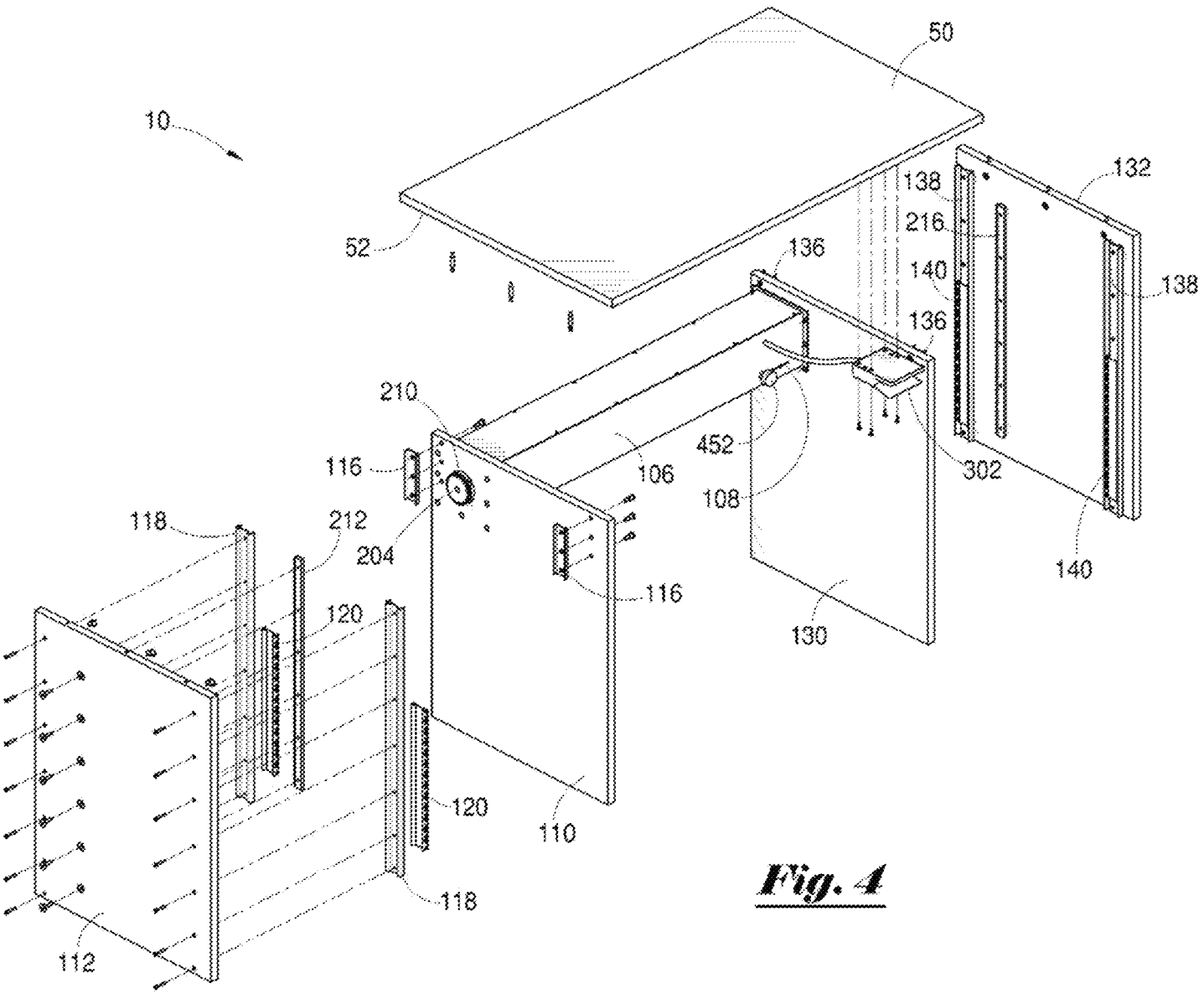
FIG. 4 is a partially exploded view of the embodiment of the adjustable height table shown in FIG. 1 with the table in the lowered position.
Figure 5:
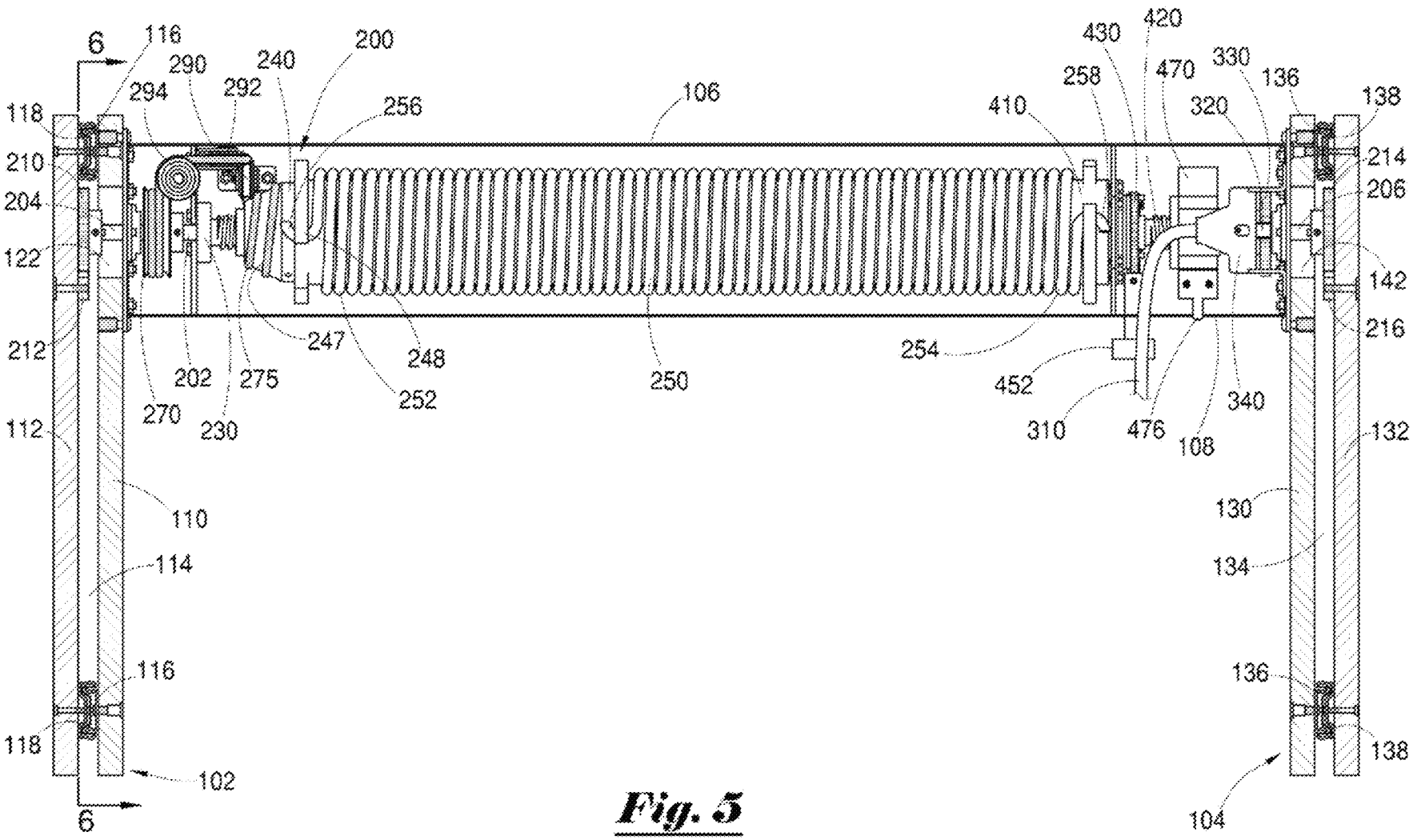
FIG. 5 is a sectional view of the embodiment of the adjustable height table shown in FIG. 1, taken along line 5-5 in FIG. 2.

With reference now to FIGS. 4 and 5, counterbalance mechanism 200 includes axle 202, which is at least partially disposed within housing 106. Axle 202 extends from first axle end 204 to second axle end 206. First axle end 204 may extend through opening 122 in first stationary leg member 110 and into first leg space 114. Second axle end 206 may extend through opening 142 in second stationary leg member 130 and into second leg space 134. A first rack and pinion assembly may engage first axle end 204 and first mobile leg member 112, and a second rack and pinion assembly may engage second axle end 206 and second mobile leg member 132. The first rack and pinion assembly may be formed of first pinion 210 engaging first rack 212 within first leg space 114. Alternatively, the first pinion 210 may engage first rack 212 within a recess formed within first mobile leg member 112. First pinion 210 may be rotationally secured to first axle end 204, and first rack 212 may be secured to first mobile leg member 112. The second rack and pinion assembly may be formed of second pinion 214 engaging second rack 216 within second leg space 134. Alternatively, the second pinion 214 may engage second rack 216 within a recess formed within second mobile leg member 132. Second pinion 214 may be rotationally secured to second axle end 206, and second pinion 214 may be secured to second mobile leg member 132.

Figure 6:
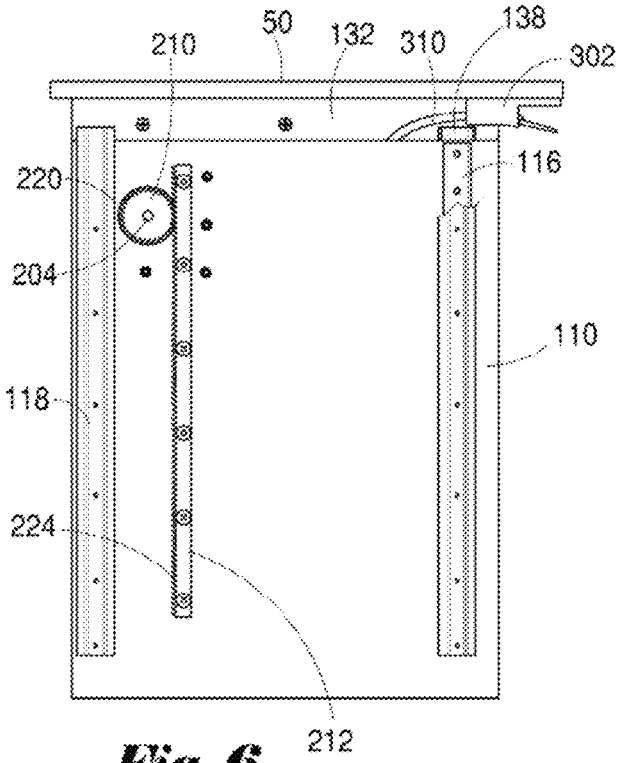
FIG. 6 is a left side cut away view of the embodiment of the adjustable height table shown in FIG. 1 with the table in the lowered position.
Figure 11:
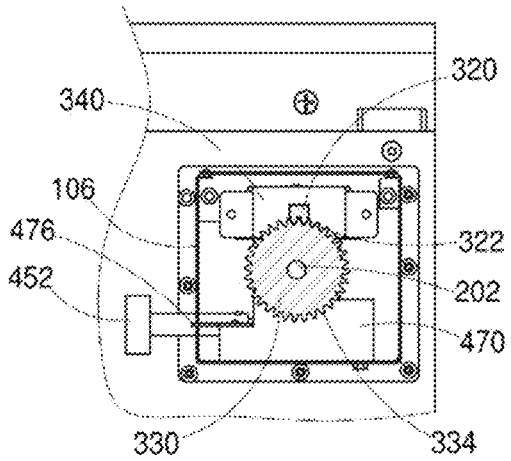
FIG. 11 is a sectional view showing an embodiment of a locking assembly in the adjustable height table of FIG. 1, taken from line 11-11 in FIG. 8B.
Figure 7:
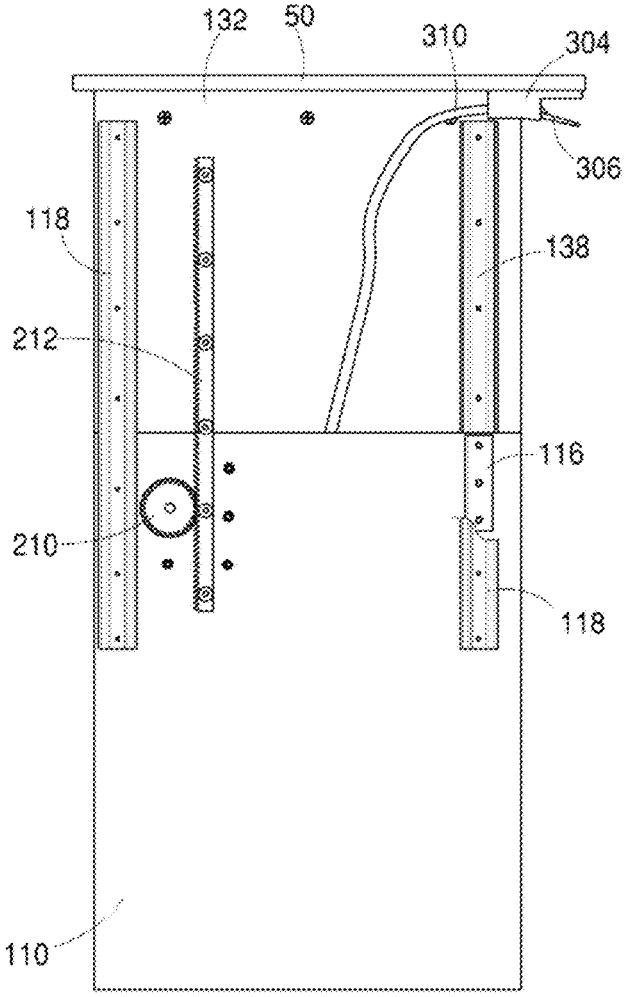
FIG. 7 is a left side cut away view of the embodiment of the adjustable height table shown in FIG. 1 with the table in the raised position.

FIGS. 6 and 7 show adjustable height table 10 in the lowered position and the raised position, respectively, with first mobile leg member 112 removed. Teeth 220 on an outer surface of first pinion 210 may engage teeth 224 on an elongated surface of first rack 212. Similarly, teeth on an outer surface of second pinion 214 may engage teeth on an elongated surface of second rack 216 (shown in FIG. 5). As adjustable height table 10 is lifted from the lowered position shown in FIG. 6 to the raised position shown in FIG. 7, first and second mobile leg members 112 and 132 move upward while first and second stationary leg members 110 and 130 remain stationary. Component 118 of the first linear motion system and first rack 212 move upward with first mobile leg member 112. Similarly, component 138 of the second linear motion system and second rack 216 move upward with second mobile leg member 132 (shown in FIGS. 4 and 5). Components 118 and 138 of the first and second linear motion systems slide over components 116 and 136 of the first and second linear motion systems, which remain stationary with first and second stationary leg members 110 and 130, respectively. As first and second racks 212 and 216 move upward, teeth 224 of first rack 212 and the teeth of second rack 216 apply a rotational force to teeth 220 of first pinion 210 and the teeth of second pinion 214, respectively. This rotational force causes first pinion 210 and second pinion 214 to rotate in a counterclockwise direction (when viewed from the direction shown in FIGS. 6 and 7), which rotates axle 202 in the counterclockwise direction because first and second pinions 210 and 214 are rotationally secured to axle 202. As used herein, "counterclockwise" means a direction that is opposite from the way in which clock hands move around a clock when viewed from the direction shown in FIGS. 6 and 7. As used herein, "clockwise" means a direction in which clock hands move around a clock when viewed from the direction shown in FIGS. 6 and 7. A skilled artisan will understand that each component of the counterbalance mechanism described as rotating in a clockwise direction may also be designed to rotate in a counterclockwise direction with appropriate adjustments within the scope of the invention. Similarly, each component described as rotating in a counterclockwise direction may also be designed to rotate in a clockwise direction with appropriate adjustments within the scope of the invention.

Counterbalance mechanism 200 applies a counterbalance lifting force on first and second racks 212 and 216 as first and second pinions 210 and 214 rotate along first and second racks 212 and 216. Specifically, the counterbalance lifting force is caused by torque on axle 202 and pinions 210 and 214, which applies an upward force on first and second racks 212 and 216. The counterbalance lifting force offsets the downward gravitational force of the table top 50 and mobile leg members 112 and 132, along with any objects resting on table top 50.

Figure 8A:
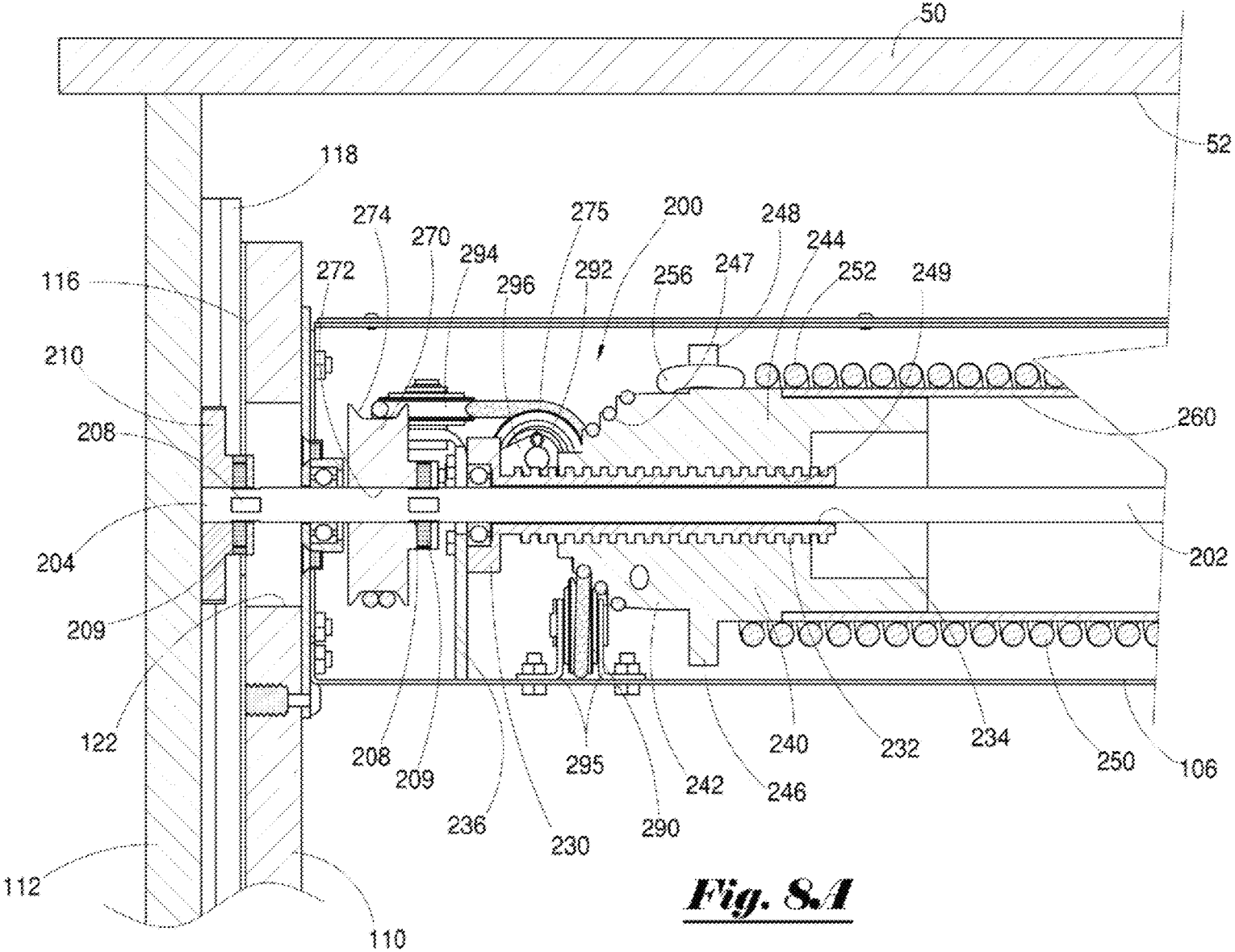
FIG. 8A is a left sectional view of the embodiment of the adjustable height table shown in FIG. 1, taken from line 8-8 in FIG. 2.

With reference to FIG. 8A, axle 202 may include two or more flat sections 208 disposed around the circumference of axle 202 at select locations along the length of axle 202. Flat sections 208 allow certain other components to be rotationally secured to axle 202 such that the other components rotate with a rotation of axle 202. For example, flat sections 208 located near first end 204 of axle 202 allow first pinion 210 to be rotationally secured to axle 202, such as with set screws 209.

Referring now to FIGS. 5, 8A, 9 and 10, counterbalance mechanism 200 may further include spring tensioner 230, spool 240, and torsion spring 250 all disposed around a central portion of axle 202 in a configuration allowing relative rotation between the axle 202 and spring tensioner 230. Spring tensioner 230 may include threaded outer portion 232 and central bore 234. Axle 202 may be disposed through central bore 234 of spring tensioner 230. Bearings may be disposed between a portion of spring tensioner 230 and axle 202. Spring tensioner 230 may be configured to not rotate and to remain stationary with housing 106 while axle 202 rotates within central bore 234. For example, spring tensioner 230 may be secured (e.g., bolted or screwed) to bracket 236, which is configured to remain stationary with housing 106 while axle 202 rotates.

Spool 240 may include cam portion 242, block portion 244, and spool shoulder 246 between cam portion 242 and block portion 244. Cam portion 242 may have a tapered profile including variable cam track 247. Block portion 244 may have a generally cylindrical shape. Spool shoulder 246 may have a generally cylindrical shape with an outer surface extending beyond the outer surface of cam portion 242 and block portion 244. Spool shoulder 246 may include a hook surface 248 created by a recess in spool shoulder 246. Spool 240 may also include threaded central bore 249. Threaded outer portion 232 of spring tensioner 230 may be disposed through and engage threaded central bore 249 of spool 240. Spool 240 is configured to rotate relative to spring tensioner 230 and axle 202. In other words, spring tensioner 230 does not rotate, while spool 240 rotates along spring tensioner 230 at a different rate from the rotation of axle 202. Spring bushing 260 may engage a distal end of block portion 244 of spool 240.

Torsion spring 250 may extend from first end 252 to second end 254, and may be disposed around block portion 244 of spool 240 and spring bushing 260. First end 252 of torsion spring 250 may include U-shaped tip 256, which may engage hook surface 248 of spool shoulder 246. Second end 254 of torsion spring 250 may include U-shaped tip 258, which is secured to a hook surface that does not rotate with spool 240 or axle 202.

Figure 10:
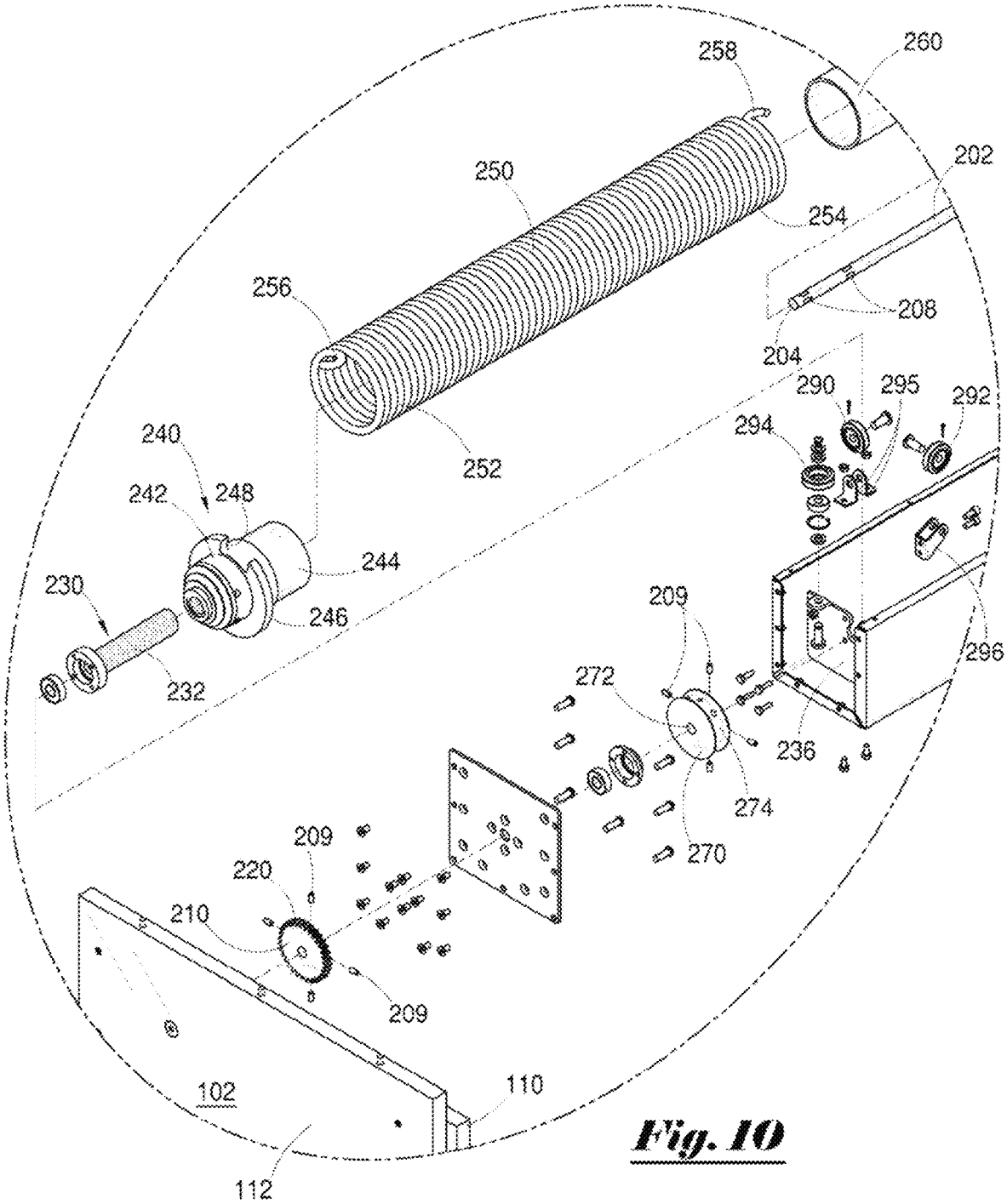
FIG. 10 is a left side detail exploded view showing the embodiment of the counterbalance mechanism of FIG. 9.

Referring still to FIGS. 5, 8A, 9 and 10, counterbalance mechanism 200 may further include rope drum 270 and lift rope 275. Rope drum 270 is rotationally secured to axle 202, which may be disposed through central bore 272 of rope drum 270. In one embodiment, rope drum 270 is rotationally secured to axle 202 through the interaction of set screws 209 secured through apertures in rope drum 270 and engaging flat sections 208 along the outer surface of axle 202. Rope drum 270 may have a generally cylindrical shape including rope track 274 along its outer surface. Lift rope 275 may extend from a first end secured to rope drum 270 to a second end secured to cam portion 242 of spool 240. Lift rope 275 may wrap around rope track 274 of rope drum 270 and wrap around variable cam track 247 of spool 240. A series of pulleys may guide lift rope 275 between rope drum 270 and spool 240. For example, lift rope 275 may engage a track of fixed pulley 290 and tracks on each of intermediate pulleys 292 and 294. Each of the pulleys may be formed as a generally cylindrical member including a track configured to receive lift rope 275 along its outer circumferential surface. Each of the pulleys may be configured to rotate around a pin disposed through a central bore of the pulley as lift rope 275 travels over the track of the pulley. Fixed pulley 290 may remain stationary relative to housing 106. For example, fixed pulley 290 may rotate around a pin secured to brackets 295, which are secured to housing 106 as shown in FIGS. 8A and 10. Intermediate pulleys 292 and 294 may rotate around pins secured to other brackets, such as bracket 236 and bracket 296 as shown in FIGS. 8A and 10.

Referring again to FIGS. 5 and 8A, torsion spring 250 applies a torque or a rotational force in a counterclockwise direction on spool 240 through the interaction of U-shaped tip 256 of torsion spring 250 with hook surface 248 of spool 240. The torque on spool 240 pulls lift rope 275 toward and onto variable cam track 247 of spool 240, which applies a rotational force in a counterclockwise direction on rope drum 270, along with axle 202 and first and second pinions 210 and 214, which all rotate together with rope drum 270. The counterclockwise torque applied to first and second pinions 210 and 214 applies an upward force on first and second racks 212 and 216, along with first and second mobile leg members 112 and 132 to which first and second racks 212 and 216 are attached. In this way, counterbalance mechanism 200 applies a upward force on first and second mobile leg members 112 and 132 and table top 50, which counteracts the downward force created by the force of gravity acting on these components and any objects supported by table top 50. The configuration of rope drum 270, lift rope 275, spool 240, and spring tensioner 230 enables counterbalance mechanism 200 to apply an equalized counterbalance force, i.e., an approximately consistent counterbalance lifting force in all positions of table 10.

Lift rope 275 travels between rope drum 270 and variable cam track 247 as the position of table 10 is adjusted. In other words, the length of lift rope 275 wrapped on rope drum 270 and variable cam track 247 varies as table 10 is adjusted from the lowered position shown in FIGS. 2 and 6 to the raised position shown in FIGS. 3 and 7. In the raised position, a maximum wrapped length of lift rope 275 is on rope drum 270 and a minimum wrapped length of lift rope 275 is on variable cam track 247. In the lowered position, a maximum wrapped length of lift rope 275 is on variable cam track 247 and a minimum wrapped length of lift rope 275 is on rope drum 270.

As table top 50 is lifted from the lowered position, first mobile leg member 112 and first rack 212 move upward. The upward movement of first rack 212 rotates first pinion 210 in a counterclockwise direction, which rotates axle 202 and rope drum 270 in the same direction. Rotation of rope drum 270 in this direction effectively unwinds a length of lift rope 275 from rope drum 270. In other words, rotation of rope drum 270 allows a length of lift rope 275 to disengage rope drum 270 and slide along intermediate pulley 294, intermediate pulley 292, and fixed pulley 290 and engage variable cam track 247. The transferred length of lift rope 275 will engage a progressively smaller diameter section of variable cam track 247 as table top 50 is lifted to a greater height position, and ultimately to the raised position in which the lift rope 275 engages a maximum portion of variable cam track 247 (e.g., the entire variable cam track 247). The transfer of lift rope 275 onto a greater portion of variable cam track 247 allows spool 240 to rotate in a counterclockwise direction under the torque applied by torsion spring 250. As spool 240 rotates in the counterclockwise direction, it moves transversely along spring tensioner 230 in a direction away from first stationary leg member 110 to align lift rope 275 leaving variable cam track 247 with fixed pulley 290.

As table top 50 is lowered from the raised position, first mobile leg member 112 and first rack 212 move downward. The downward movement of first rack 212 rotates first pinion 210 in a clockwise direction, which rotates axle 202 and rope drum 270 in the same direction. Rotation of rope drum 270 in the clockwise direction effectively winds a greater length of lift rope 275 onto rope drum 270. In other words, rotation of rope drum 270 causes a length of lift rope 275 to disengage variable cam track 247, to slide along fixed pulley 290, intermediate pulley 292, and intermediate pulley 294, and to engage rope drum 270. As a length of lift rope 275 is transferred, lift rope 275 will depart from a progressively larger diameter section of variable cam track 247 as table top 50 is lowered to a lower height position, and ultimately to the lowered position in which the lift rope 275 engages a minimum portion of variable cam track 247. This transfer of lift rope 275 causes spool 240 to rotate in a clockwise direction under the force transferred from rope drum 270 to lift rope 275, thereby twisting first end 252 of torsion spring 250 with hook surface 248 of spool 240. As spool 240 rotates in the clockwise direction, it moves along spring tensioner 230 in a direction toward first stationary leg member 110 to align lift rope 275 leaving variable cam track 247 with fixed pulley 290.

As spool 240 rotates in a clockwise direction on spring tensioner 230 when table 10 is being lowered, hook surface 248 of spool 240 twists first end 252 of torsion spring 250. The degree of twisting of torsion spring 250 varies as spool 240 rotates (i.e., as the position of table 10 is adjusted). Specifically, a greater rotation of spool 240 in the clockwise direction leads to a greater degree of twisting of torsion spring 250 from a default position. As the clockwise rotation of spool 240 twists torsion spring 250 to a greater degree and increases the torque exerted by torsion spring 250, lift rope 275 departs from a larger diameter portion of variable cam track 247, which acts as a larger lever arm. The larger lever arm causes spool 240 to apply a more consistent or equalized force on lift rope 275, which translates into a more consistent counterbalance lifting force applied by first and second pinions 210 and 214 on first and second mobile leg members 112 and 132. In other words, variable cam track 247 acts as a variable lever arm in converting the variable torque applied by torsion spring 250 on spool 240 into an equalized and more consistent linear force acting on lift rope 275, which applies an equalized and more consistent torque on rope drum 270, axle 202, and first and second pinions 210 and 214. In this way, spring tensioner 230, spool 240, rope drum 270, and lift rope 275 together form an equalizing assembly that translates the torque exerted by the torsion spring (which varies with height position adjustment) into the equalized counterbalance lifting force exerted on the first and second racks 212 and 216.

In the lowered position, torsion spring 250 may apply a maximum torque value on spool 240 and lift rope 275 may depart from a larger diameter portion of variable cam track 247 to create a maximum lever arm. In the raised position, torsion spring 250 may apply a minimum torque value on spool 240 and lift rope 275 may depart from a smaller diameter portion of variable cam track 247 to create a minimum lever arm. In both positions and intermediate positions therebetween, counterbalance mechanism 200 may apply an equalized counterbalance lifting force on first and second mobile leg members 112 and 132.

Figure 8B:
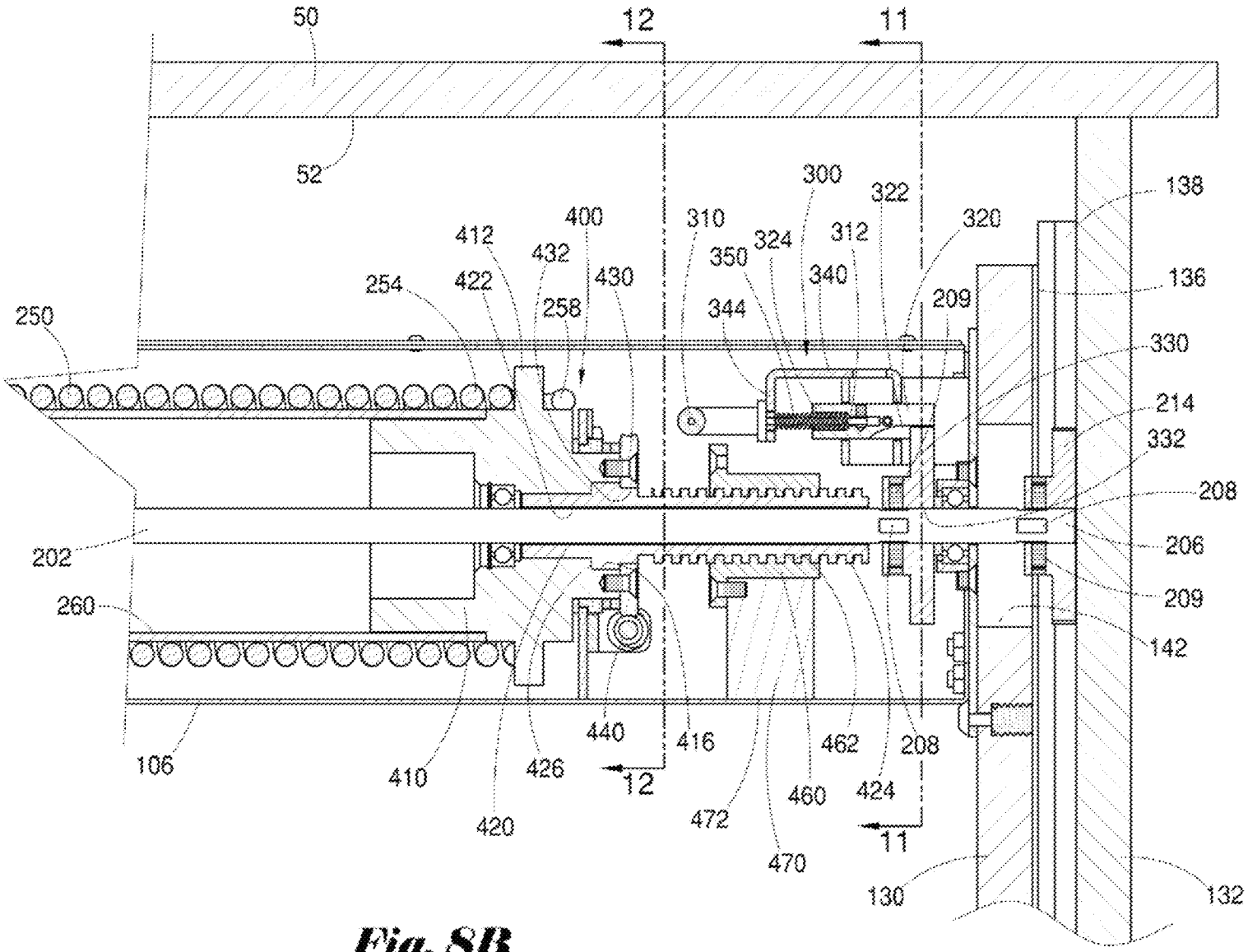
FIG. 8B is a right sectional view of the embodiment of the adjustable height table shown in FIG. 1, taken from line 8-8 in FIG. 2.
Figure 9:
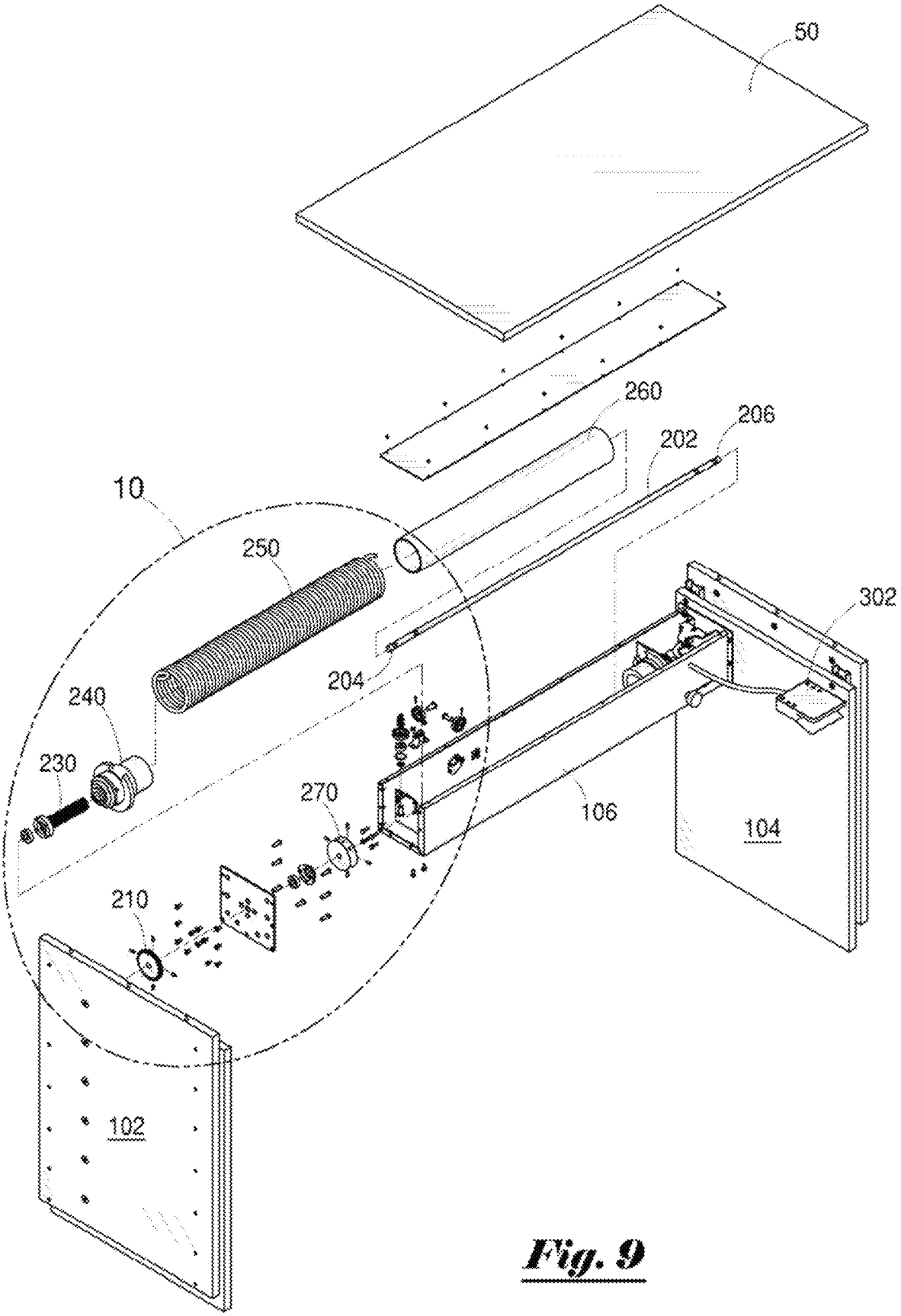
FIG. 9 is a left side partially exploded view showing an embodiment of a counterbalance mechanism of the adjustable height table shown in FIG. 1.
Figure 13:
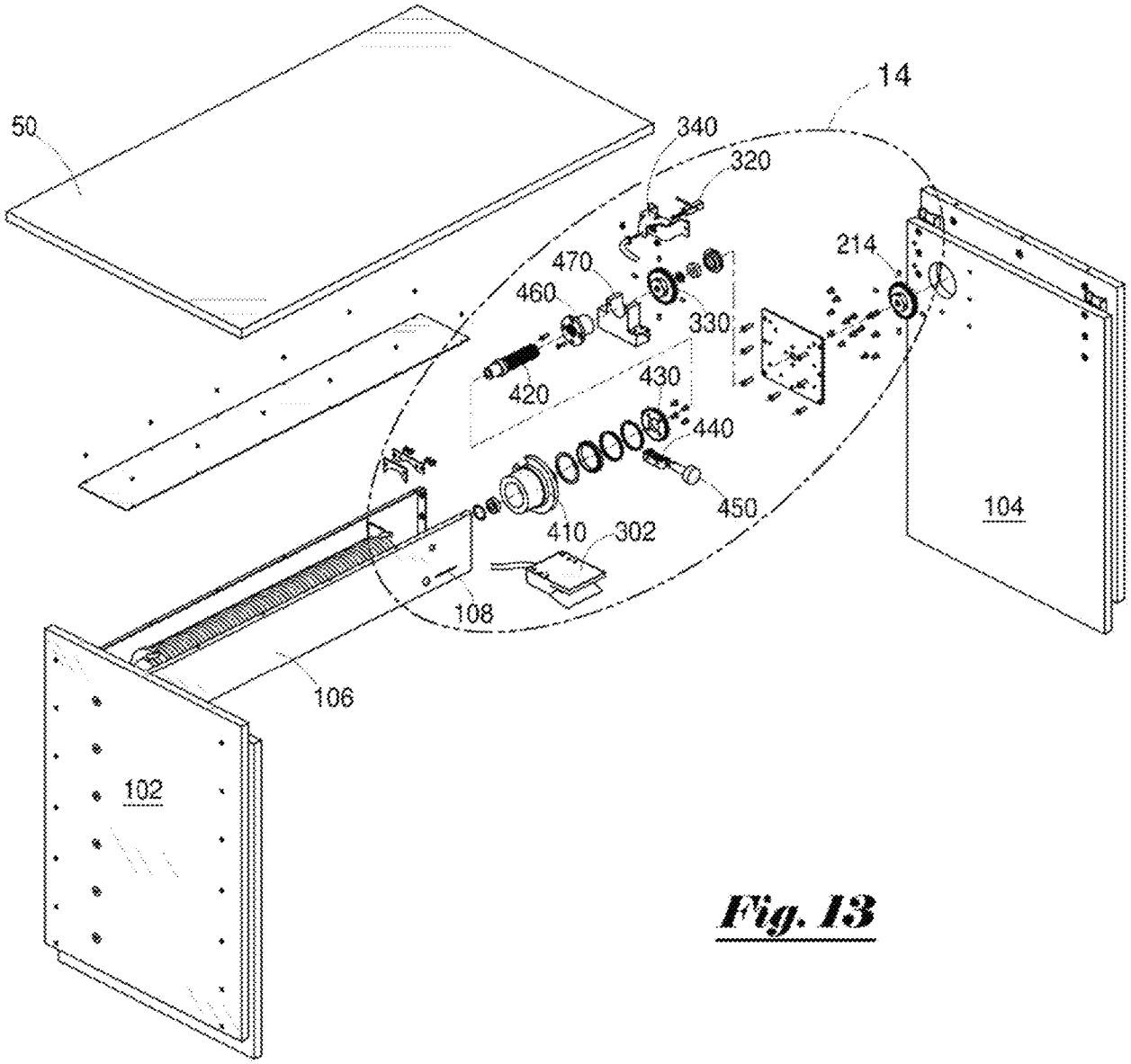
FIG. 13 is a right side partial exploded view showing the embodiment of the force adjustment mechanism of FIG. 8 and the embodiment of the locking assembly of FIG. 9.
Figure 14:
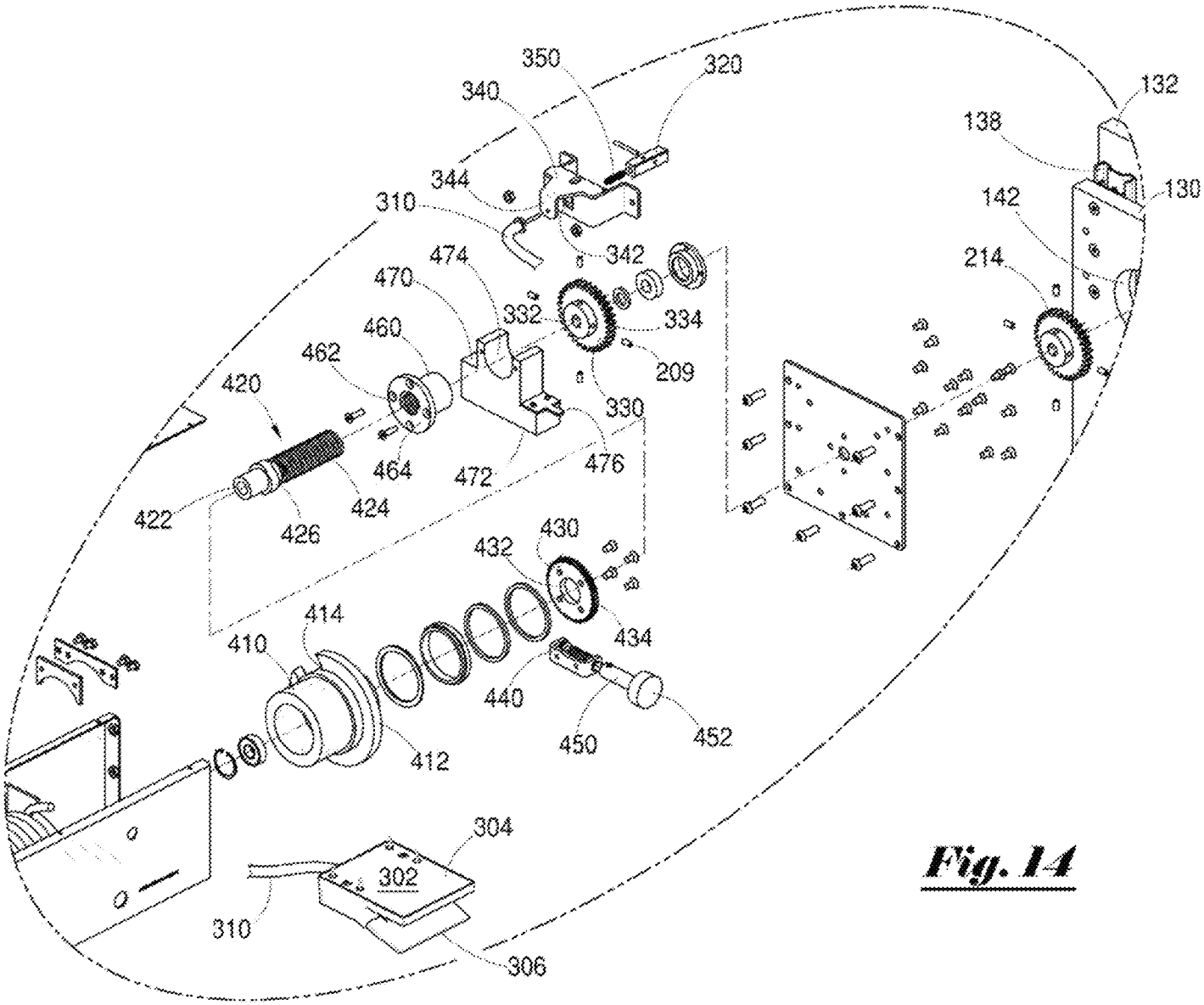
FIG. 14 is a right side detail exploded view showing the embodiment of the force adjustment mechanism and the locking assembly of FIG. 13.

With reference now to FIGS. 8B, 13, and 14, adjustable height table 10 may further include brake mechanism 300. A portion of brake mechanism 300 may be disposed within housing 106. In a locked position, brake mechanism 300 is configured to prevent adjustment of the height position of table top 50. In a released position, brake mechanism 300 is configured to allow adjustment of the height position of table top 50. The default position of brake mechanism 300 may be the locked position, and the brake mechanism 300 may be placed in the released position upon activation of a brake release control.

Referring still to FIGS. 8B, 13, and 14, adjustable height table 10 may further include force adjustment mechanism 400, a portion of which may be disposed within housing 106. Force adjustment mechanism 400 may include spring hub 410, charge control screw 420, worm gear 430, and worm 440. Charge control screw 420 may be generally cylindrical and may include central bore 422, threaded outer portion 424, and shoulder 426. Central bore 422 of charge control screw 420 is configured to receive axle 202 therethrough in an arrangement allowing relative rotation between charge control screw 420 and axle 202. Shoulder 426 may include a non-cylindrical outer surface. For example, the outer surface of shoulder 426 may include one or more flat surfaces.

Spring hub 410 may have a generally cylindrical shape and may be prevented from moving in an axial direction in relation to axle 202. Spring hub 410 may include a central bore and shoulder 412 including hook surface 414 configured to engage U-shaped tip 258 of torsion spring 250. Spring bushing 260 may engage a first end of spring hub 410. Axle 202 may be disposed through the central bore of spring hub 410, along with one or more bearings and/or washers. Spring hub 410 may be configured to rotate independently from a rotation of axle 202. A portion of charge control screw 420 may also be disposed through the central bore of spring hub 410. Varied surface 416 within the central bore of spring hub 410 may include a non-cylindrical outer surface having a reciprocal shape to shoulder 426 of charge control screw 420 in order to rotationally secure spring hub 410 to charge control screw 420. Rotation of spring hub 410 may twist second end 254 of torsion spring 250. For example, rotation of spring hub 410 in a clockwise direction may decrease the degree to which spring hub 410 twists second end 254 of torsion spring 250, while rotation of spring hub 410 in a counterclockwise direction may increase the degree to which spring hub 410 twists second end 254 of torsion spring 250.

Figure 12:
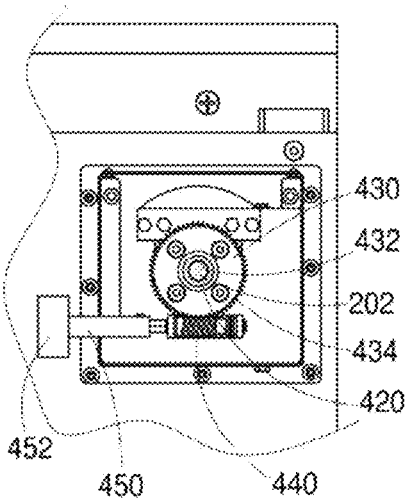
FIG. 12 is a sectional view showing an embodiment of a force adjustment mechanism in the adjustable height table of FIG. 1, taken from line 12-12 in FIG. 8B.

Worm gear 430 may have a generally cylindrical shape including central bore 432 and a plurality of teeth 434 on its outer surface. Worm gear 430 may be secured to a second end of spring hub 410, such as with bolts or screws. Charge control screw 420 may be disposed through central bore 432 of worm gear 430. In this way, worm gear 430 is rotationally secured to spring hub 410 and to charge control screw 420. Accordingly, rotation of worm gear 430 rotates spring hub 410 and charge control screw 420. Worm 440 may be disposed below worm gear 430 in a transverse position relative to axle 202. Worm 440 may include an outer surface configured to engage the plurality of teeth 434 of worm gear 430 such that rotation of worm 440 rotates worm gear 430, as shown in FIG. 12. Charge handle 450 may be secured to worm 440 such that rotation of charge handle 450 rotates worm 440. Charge handle 450 may extend through housing 106 such that end 452 of charge handle 450 is accessible from the outside of housing 106, as shown in FIGS. 5 and 12. Accordingly, rotation of charge handle 450 from outside of housing 106 rotates worm 440 to rotate worm gear 430, spring hub 410, and charge control screw 420 within housing 106. Rotation of spring hub 410 may twist second end 254 of torsion spring 250 in order to adjust a preset minimum torque applied by torsion spring 250 on spool 240, and to adjust a preset equalized counterbalance lifting force applied by first and second pinions 210 and 214 on first and second mobile leg members 112 and 132, in all height positions of table 10. In this way, rotation of charge handle 450 adjusts the "charge" (i.e., the preset minimum torque and preset equalized counterbalance lifting force) of the counterbalance mechanism 200 of table 10. The charge of counterbalance mechanism 200 may be adjusted when objects of varying weights are placed on or removed from table top 50. At these times, it may be helpful to increase or decrease the equalized counterbalance lifting force applied by counterbalance mechanism 200 on first and second mobile leg members 112 and 132.

Force adjustment mechanism 400 may further include a charge control mechanism configured to limit the degree to which second end 254 of torsion spring 250 is charged by spring hub 410. In one embodiment, the charge control mechanism includes charge control screw 420, charge control drum 460 disposed around charge control screw 420, and charge control shoe 470 secured to charge control drum 460. Charge control drum 460 may have a generally cylindrical shape, and may include a threaded central bore 462 and a flange 464. Threaded outer portion 424 of charge control screw 420 may be disposed through threaded central bore 462 of charge control drum 460. Charge control shoe 470 may be configured to slide along a lower surface of housing 106 without rotation. For example, charge control shoe 470 may include flat lower surface 472 that engages a lower surface of housing 106. Charge control shoe 470 may also include drum seat 474 having a shape that is reciprocal to an outer surface of charge control drum 460. Flange 464 of charge control drum 460 may be secured to charge control shoe 470 such that charge control drum 460 does not rotate relative to charge control shoe 470.

As spring hub 410 rotates in response to a rotation of charge handle 450, charge control screw 420 rotates within threaded central bore 462 of charge control drum 460. Because spring hub 410 is configured not to move along the axis of axle 202, this rotation of charge control screw 420 causes charge control drum 460 and charge control shoe 470 to move transversely along threaded outer portion 424 of charge control screw 420. Upon further rotation of spring hub 410 in one direction, charge control drum 460 and charge control shoe 470 may engage an element that acts as a stopping point, thereby preventing further movement of charge control drum 460 and charge control shoe 470 as well as preventing further rotation of spring hub 410 in the same direction. In one embodiment, one stopping point may be created by charge control drum 460 engaging worm gear 430, and another stopping point may be created by charge control drum 460 engaging spur gear 330. In this way, the charge control mechanism limits the degree of rotation of charge handle 450 and ultimately the degree of rotation of spring hub 410 in both directions to limit the degree to which second end 254 of torsion spring 250 may be charged. In certain embodiments, the force adjustment mechanism includes a charge indicator that is visible to a user. The charge indicator may be formed of any mechanism for displaying the degree of rotation of charge handle 450. For example, but not by way of limitation, charge control shoe 470 may further include charge indicator 476, which may be visible through an opening or window 108 in housing 106, as shown in FIGS. 5 and 14.

In some embodiments, the racks of the rack and pinion assemblies may be secured to the stationary leg members. In other embodiments, the adjustable height table may include a counterbalance mechanism using an extension spring or a compression spring. In certain embodiments, the counterbalance adjustable height table of the present invention may use a rope and drum system or a bolt and nut actuator system to lift the mobile leg members and the table top instead of rack and pinion assemblies.

Figure 15:
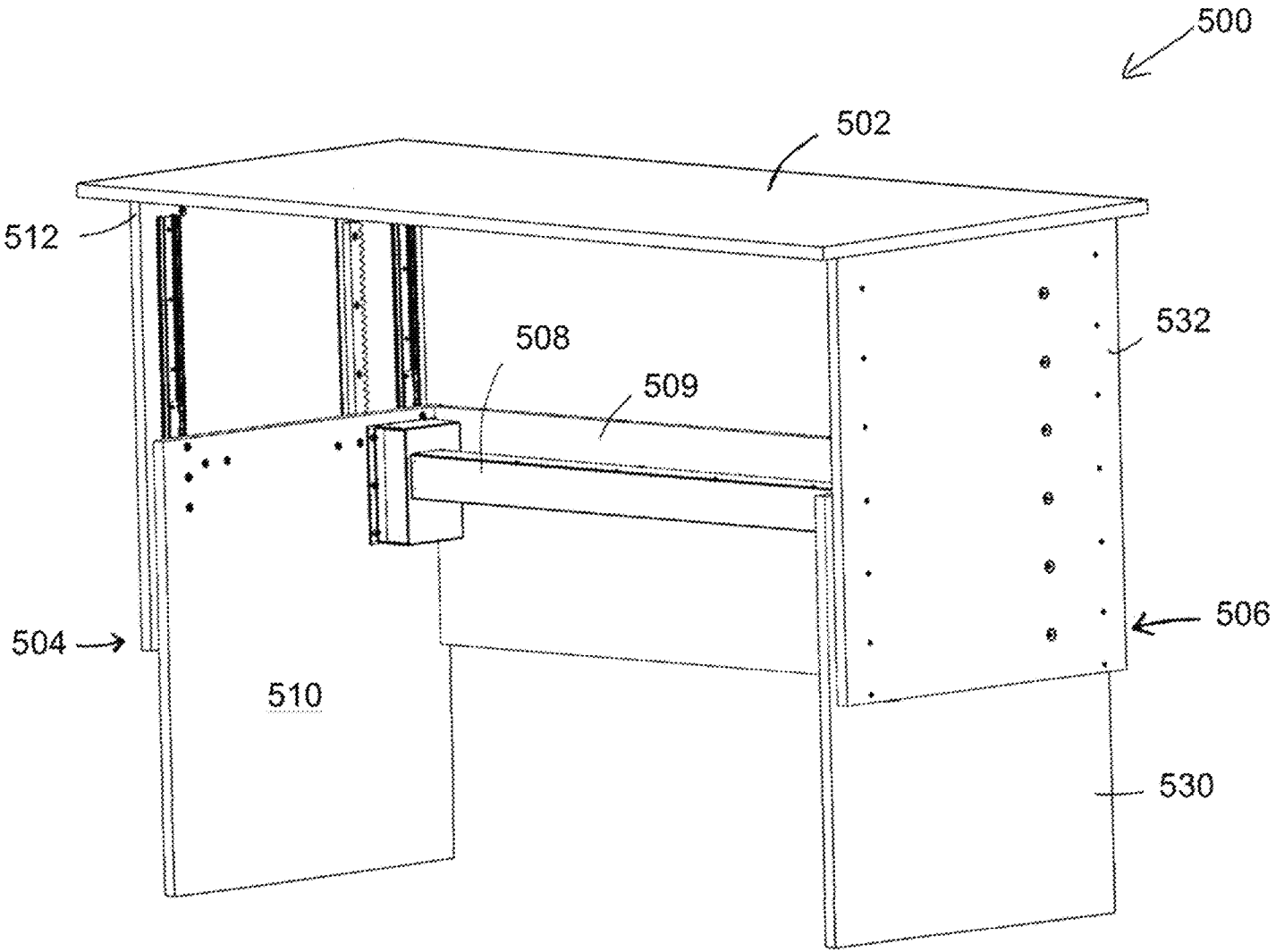
FIG. 15 is a perspective view of an embodiment of an electric adjustable height table exemplifying certain principles of the present invention with the table in a raised position.
Figure 16:
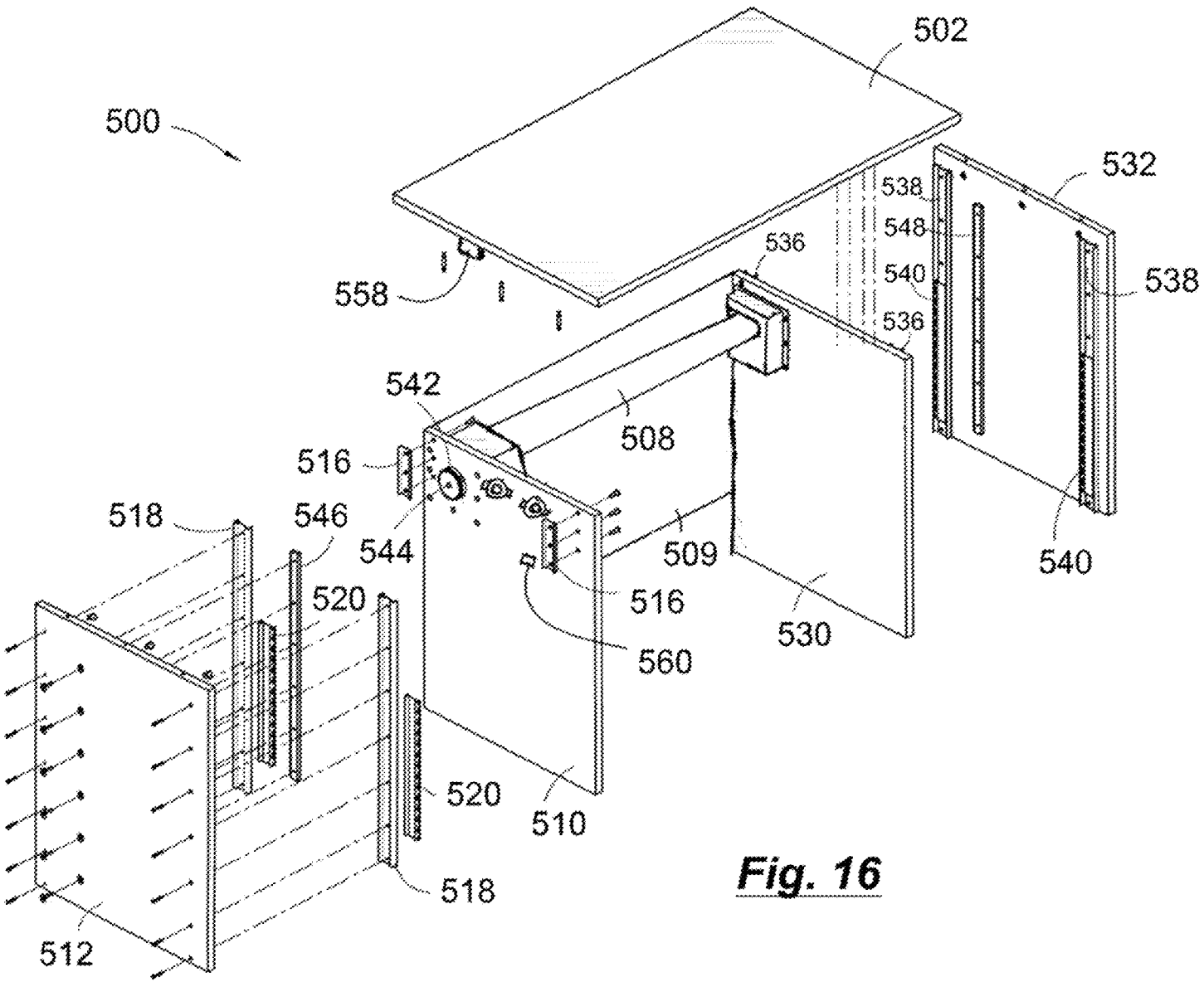
FIG. 16 is a partially exploded view of the embodiment of the electric adjustable height table shown in FIG. 15.

FIGS. 15 and 16 illustrate an electric adjustable height table exemplifying the principles of the present invention with the table in a raised position. Electric adjustable height table 500 may include a table top 502 supported by a base assembly, which includes two or more leg assemblies. In the illustrated embodiment, table 500 includes first leg assembly 504 and second leg assembly 506. First and second leg assemblies 504 and 506 may each be configured to extend and retract to adjust a height position of table 500 between a lowered position and the raised position shown in FIG. 15. First and second leg assemblies 504 and 506 may be connected to table top 502 near the edges of table top 502 with a bridge extending between the first and second leg assemblies. In the illustrated embodiment, the bridge may include housing 508 and certain components disposed within housing 508. Table 500 may be electrically powered. For example, an electric motor and other electric components may be disposed within housing 508. The electric motor may be configured to raise and lower table top 502 between the raised and lowered positions. Optionally, panel 509 may extend along with housing 508 between the first and second leg assemblies 504 and 506. Except as otherwise described, table top 502 and leg assemblies 504 and 508 have the same features and functions described in connection with table top 50 and leg assemblies 102 and 104.

Referring still to FIGS. 15 and 16, first leg assembly 504 may include first stationary leg member 510 coupled to first mobile leg member 512. First stationary leg member 510 may contact a floor, while first mobile leg member 512 is secured to a lower side of table top 502. In the illustrated embodiment, one or more components 516 and 518 of a first linear motion system may be secured between the stationary and mobile leg members in a first leg space defined between first stationary leg member 510 and first mobile leg member 512. In other embodiments, components 516 and 518 of the first linear motion system may not be disposed in the first leg space. The first linear motion system with components 516 and 518 may be formed of rails, drawer slides, linear glides, glides, rollers, racks and gears, custom sliders, or any other device configured to provide a reduced friction and smooth sliding motion between the mobile and stationary leg members. For example, but not by way of limitation, components 516, 518, and 520 of the first linear motion system may be constructed as a single unit. In FIGS. 15 and 16, the first linear motion system is formed of rails, drawer slides. Linear motion system components 516 and 518 may be engaged to allow first mobile leg member 512 to move vertically relative to first stationary leg member 510 as table top 502 is adjusted between the lowered position shown in FIG. 17 and the raised position shown in FIGS. 15 and 18. For example, but not by way of limitation, slide component 516 may slide within slide component 518. The electric power mechanism may alternatively be connected to either stationary leg member 510 or mobile leg member 512. If connected to the mobile leg member 512, the electric power mechanism may also be connected to the table top.

Similarly, second leg assembly 506 may include second stationary leg member 530 and second mobile leg member 532. Second stationary leg member 530 may contact a floor, while second mobile leg member 532 is secured to the lower side of table top 502. One or more components 536 and 538 of a second linear motion system may be secured between the stationary and mobile leg members in a space defined between second stationary leg member 530 and second mobile leg member 532. The second linear motion system with components 536 and 538 may be formed of rails, drawer slides, linear glides, glides, rollers, racks and gears, custom sliders, or any other device configured to provide a reduced friction and smooth sliding motion between the mobile and stationary leg members. For example, but not by way of limitation, components 536, 538, and 540 of the second linear motion system may be constructed as a single unit. In FIGS. 15 and 16, the second linear motion system is formed of drawer slides. Linear motion system components 536 and 538 may be engaged to allow second mobile leg member 532 to move vertically relative to second stationary leg member 530 as table top 502 is adjusted between the lowered and raised positions. For example, but not by way of limitation, component 536 may slide within component 538. The electric power mechanism may alternatively be connected to either stationary leg member 530 or mobile leg member 532. If connected to the mobile leg member, the electric power mechanism may also be connected to the table top.

In certain embodiments, housing 508 is secured to stationary leg members 510 and 530, such that housing 508 remains stationary as the height position of table top 502 is adjusted. This configuration reduces the weight that is required to be lifted when the height position of the table top 502 is adjusted. The lower weight requirement results in use of less electricity to adjust the height position of table 500. In other embodiments, housing 508 is secured to the mobile leg members, such that housing 508 is lifted and lowered along with table top 502 as its height position is adjusted.

With reference still to FIGS. 15 and 16, electric adjustable height table 500 may further include two pinions, including first pinion 542 and a second pinion, each secured to an end of axle 544. The first pinion 542 may be disposed within the first leg space, and the second pinion may be disposed within the second leg space. The first pinion 542 may engage and rotate along first rack 546 within the first leg space. Similarly, the second pinion may engage and rotate along second rack 548 within the second leg space. First pinion 542 and the second pinion each rotate with axle 544, while first rack 546 and second rack 548 are secured to first mobile leg member 512 and second mobile leg member 532, respectively. Axle 544 may extend between the two or more leg assemblies within housing 508. The electric motor, which may be disposed within housing 508, may be configured to cause rotation of the axle 544. In an alternate embodiment, first pinion 542 may engage first rack 546 within a recess formed in first mobile leg member 512 and the second pinion may engage second rack 548 within a recess formed in second mobile leg member 532.

Figure 17:
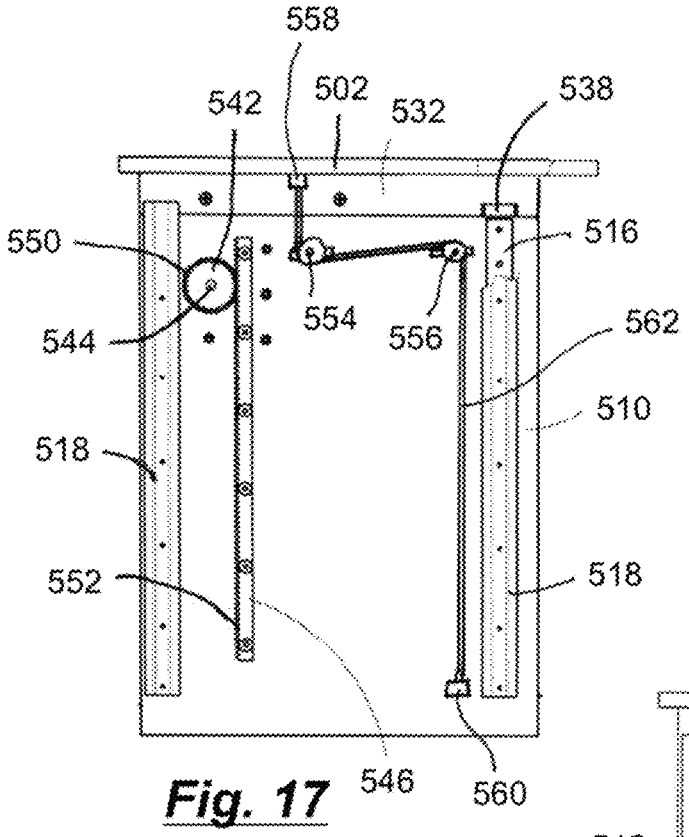
FIG. 17 is a left side cut away view of the embodiment of the electric adjustable height table shown in FIG. 15 with the table in the lowered position.
Figure 18:
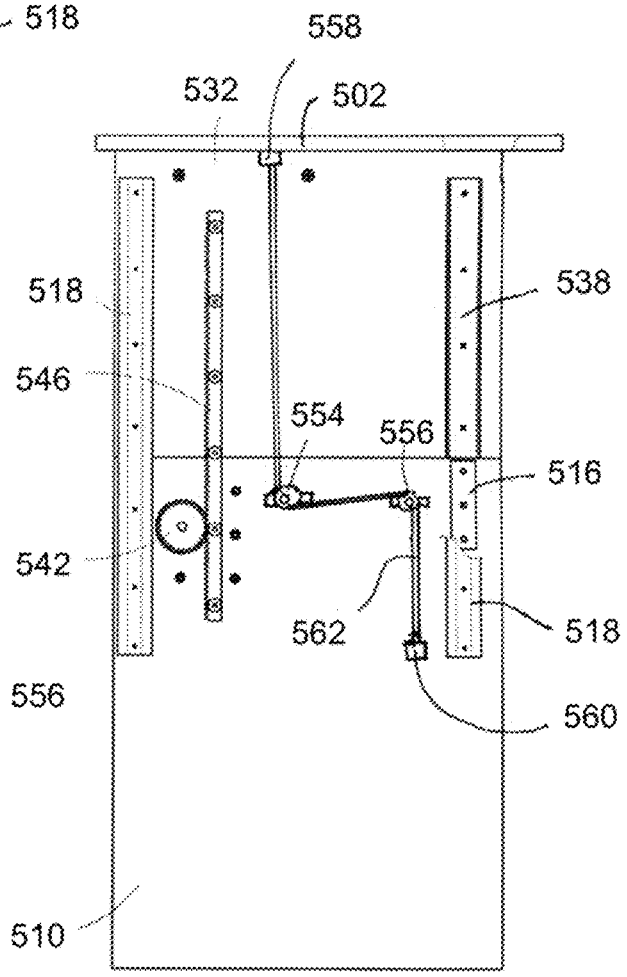
FIG. 18 is a left side cut away view of the embodiment of the electric adjustable height table shown in FIG. 15 with the table in the raised position.

FIGS. 17 and 18 show electric adjustable height table 500 in the lowered position and the raised position, respectively, with first mobile leg member 512 and a portion of one of components 518 of the first linear motion system removed. Teeth 550 on an outer surface of first pinion 542 may engage teeth 552 on an elongated surface of first rack 546. Similarly, teeth on an outer surface of the second pinion may engage teeth on an elongated surface of second rack 548 (shown in FIG. 16). Table 500 may further include a synchronizing system configured to stabilize the sliding vertical support structures against rocking. Specifically, the synchronizing system is configured to ensure that the table top 502 and the mobile leg members remain in a level orientation in relation to the stationary leg members during adjustment of the height position. The synchronizing system may synchronize the movement of the components within a linear motion system of one leg assembly. In one embodiment, the synchronizing system includes a rope or cord extending from an upper end of the rear side of each of the mobile leg members, through a series of pulleys that are secured to the associated stationary leg members, and to a lower end of the front side of each mobile leg member. The rope or cord and the pulleys may be disposed within the leg space of one of the leg assemblies. For example, pulleys 554 and 556 may be secured to first stationary leg member 510 and disposed in the first leg space. Upper anchor 558 may be secured to the lower surface of table top 502 or an upper end of the rear side of the first mobile leg member, while lower anchor 560 may be secured to a lower end of the front of the first mobile leg member. Flexible line 562 may extend from upper anchor 558 to lower anchor 560, engaging pulleys 554 and 556 therebetween. The same arrangement of pulleys, anchors, and flexible line may be connected to the second mobile and stationary leg members.

The electric motor within housing 508 may be actuated to lift table top 502 from the lowered position shown in FIG. 17 to the raised position shown in FIG. 18. The electric motor may rotate axle 544 in a counterclockwise direction, thereby rotating first pinion 542 and the second pinion in the same counterclockwise direction. This rotation of first pinion 542 and the second pinion forces first rack 546 and second rack 548 in an upward direction through the engagement of the teeth on the outer surfaces of the pinions with the teeth on the elongated surfaces of the racks. Because first and second racks 546 and 548 are secured to mobile leg members 512 and 532, the upward movement of first and second racks 546 and 548 causes upward movement of mobile leg members 512 and 532 while the stationary leg members 510 and 530 remain stationary. As mobile leg members 512 and 532 move upward, components 518 and 538 slide upward along components 516 and 536 of the first and second linear motion systems, which remain stationary with stationary leg members 510 and 530, respectively. Additionally, upper and lower anchors 558 and 560 moves upward with mobile leg member 512 and table top 502, while pulleys 554 and 556 remain stationary with stationary leg member 510. As anchors 558 and 560 move upward, flexible line 562 is pulled over pulleys 554 and 556 to position a longer length of flexible line 562 above pulley 554.

Conversely, the electric motor within housing 508 may be actuated to lower table top 502 from the raised position shown in FIG. 18 into the lowered position shown in FIG. 17. The electric motor may rotate axle 544, along with first pinion 542 and the second pinion, in a clockwise direction. This rotation of first pinion 542 and the second pinion forces first rack 546 and second rack 548 in a downward direction through the engagement of teeth on the outer surfaces of the pinions with the teeth on the elongated surfaces of the racks. The downward movement of first and second racks 546 and 548 causes downward movement of mobile leg members 512 and 532 while the stationary leg members 510 and 530 remain stationary. As mobile leg members 512 and 532 move downward, components 518 and 538 slide downward along components 516 and 536 of the first and second linear motion systems, which remain stationary with stationary leg members 510 and 530, respectively. Additionally, upper and lower anchors 558 and 560 moves downward with mobile leg member 512 and table top 502, while pulleys 554 and 556 remain stationary with stationary leg member 510. As anchors 558 and 560 move downward, flexible line 562 is pulled over pulleys 554 and 556 to position a longer length of flexible line 562 below pulley 556.

In the embodiment illustrated in FIG. 16, the electric adjustable height table includes a single electric motor that rotates a shaft extending between the two or more leg assemblies. In other embodiments, the electric adjustable height table may include two electric motors (i.e., double motor). In some double motor embodiments, each electric motor may be disposed near a leg assembly and no shaft or housing extends between the two or more leg assemblies. Other double motor embodiments may include a shaft and/or housing extending between the two or more leg assemblies. Each electric motor may lift and lower the associated leg assembly. Both single motor embodiments and double motor embodiments of the electric adjustable height table may be configured to include a control system or configured without the control system. If included, the control system may synchronize the lifting and lowering of the two or more leg assemblies. In certain embodiments, the electric adjustable height table of the present invention may use a rope and drum system or a bolt and nut actuator system to lift the mobile leg members and the table top instead of rack and pinion assemblies.

Panel 509 provides aesthetic advantages by masking housing 508. Additionally, panel 509 and housing 508 are positioned together at one end of table top 502, thereby maximizing leg room for a user seated at table 500 in the lowered position. In certain embodiments, panel 509 and housing 508 remain stationary with stationary leg members 510 and 530. This configuration provides weight advantages because panel 509, housing 508, and all components within housing 508 are not required to be lifted in order to move table top 502 from the lowered position into the raised position. In other embodiments, panel 509 and housing 508 are attached to mobile leg members 512 and 532 and/or table top 502. In this alternate configuration, panel 509 and housing 508 travel vertically with table top 502 when its position is adjusted between the lowered position and the raised position.

Figure 19:
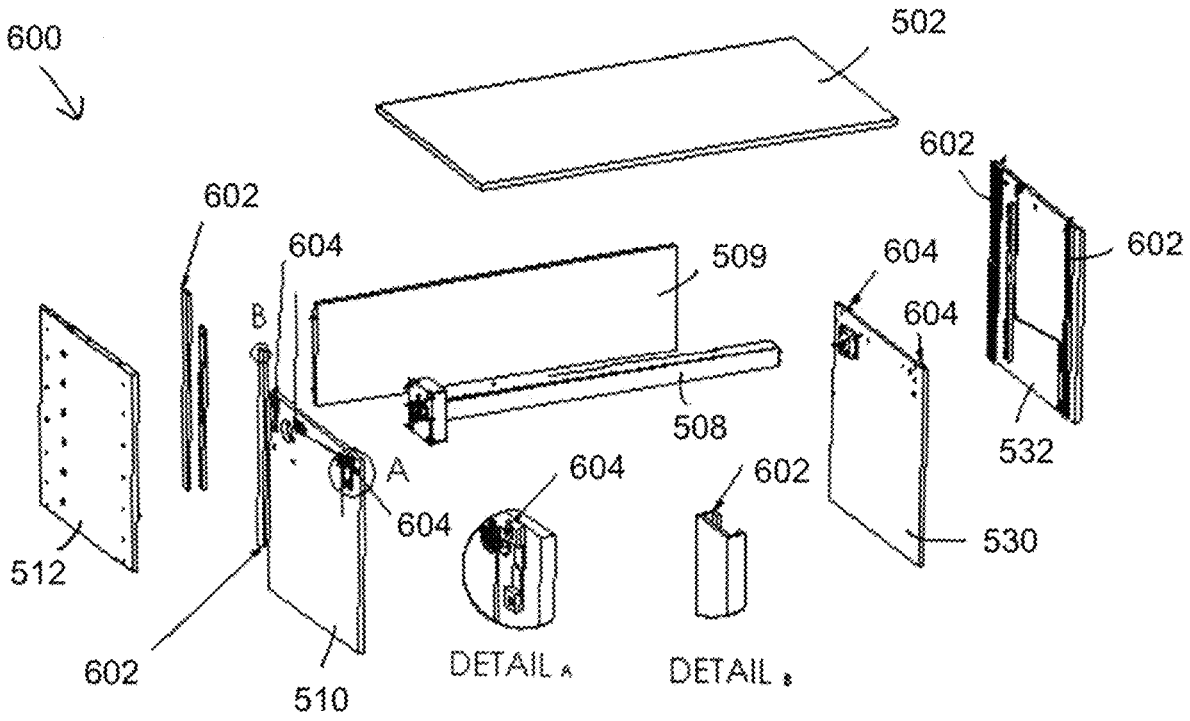
FIG. 19 is an exploded view of another embodiment of an electric adjustable height table including a linear motion system comprising glides and rails.

FIG. 19 illustrates another embodiment of an electric adjustable height table exemplifying the principles of the present invention. Except as otherwise described, electric adjustable height table 600 includes the same features and functions described in connection with table 500 as noted with like reference numerals. The linear motion systems in the first and second leg assemblies of table 600 each comprise rails 602 and glides 604. In some embodiments, rails 602 may be secured to the mobile leg members 512 and 532, with glides 604 secured to the stationary leg members 510 and 530. In other embodiments, rails 602 may be secured to stationary leg member 510 and 530, with glides 604 secured to the mobile leg member 512 and 532. Glides 604 may be sized to fit and slide within rails 602 in order to permit the mobile leg members to slide past the stationary leg members in a vertical linear direction. In other embodiments, rails 602 may be sized to fit and slide within glides 604 in order to permit the mobile leg members to slide past the stationary leg members in a vertical linear direction.

Figure 20:
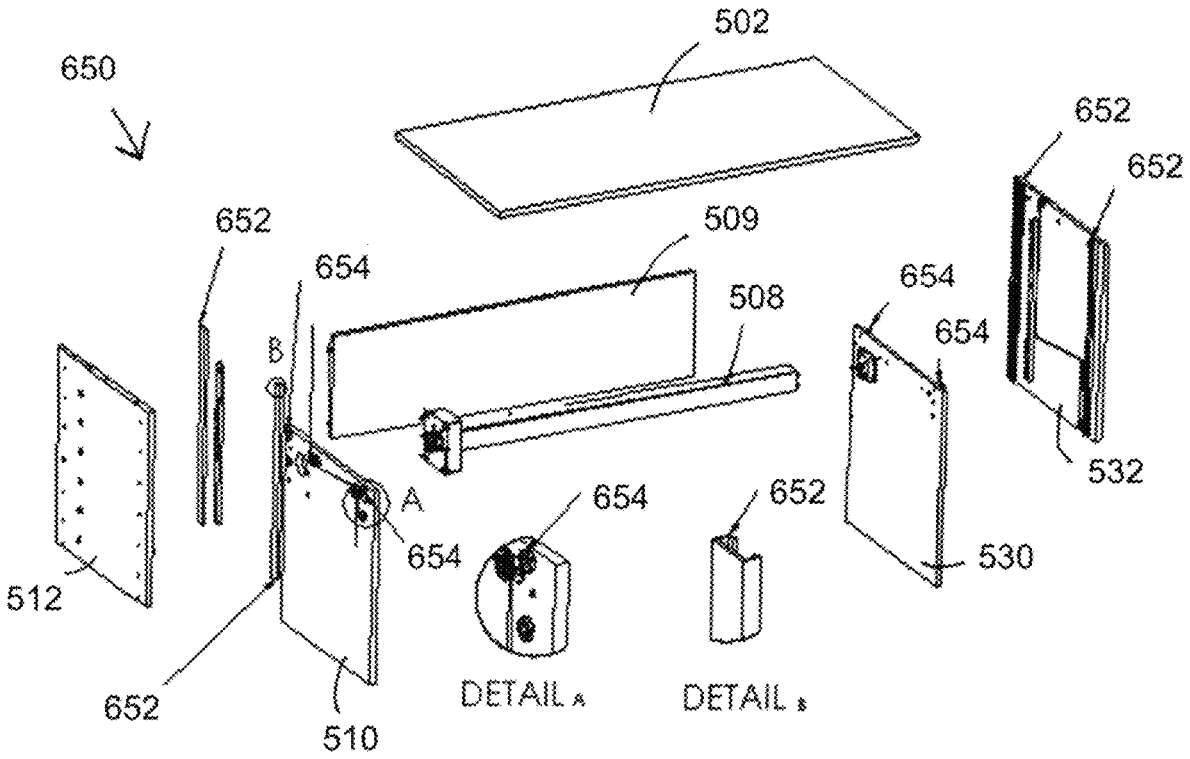
FIG. 20 is an exploded view of another embodiment of an electric adjustable height table including a linear motion system comprising rollers and rails.

FIG. 20 illustrates another embodiment of an electric adjustable height table exemplifying the principles of the present invention. Except as otherwise described, electric adjustable height table 650 includes the same features and functions described in connection with table 500 as noted with like reference numerals. The linear motion systems in the first and second leg assemblies of table 650 each comprise rails 652 and rollers 654. In some embodiments, rails 652 may be secured to the mobile leg members 512 and 532, with rollers 654 secured to the stationary leg members 510 and 530. In other embodiments, rails 652 may be secured to stationary leg member 510 and 530, with rollers 654 secured to the mobile leg member 512 and 532. Rollers 654 may be sized to fit and roll within rails 652 in order to permit the mobile leg members to slide past the stationary leg members in a vertical linear direction.

Figure 21:
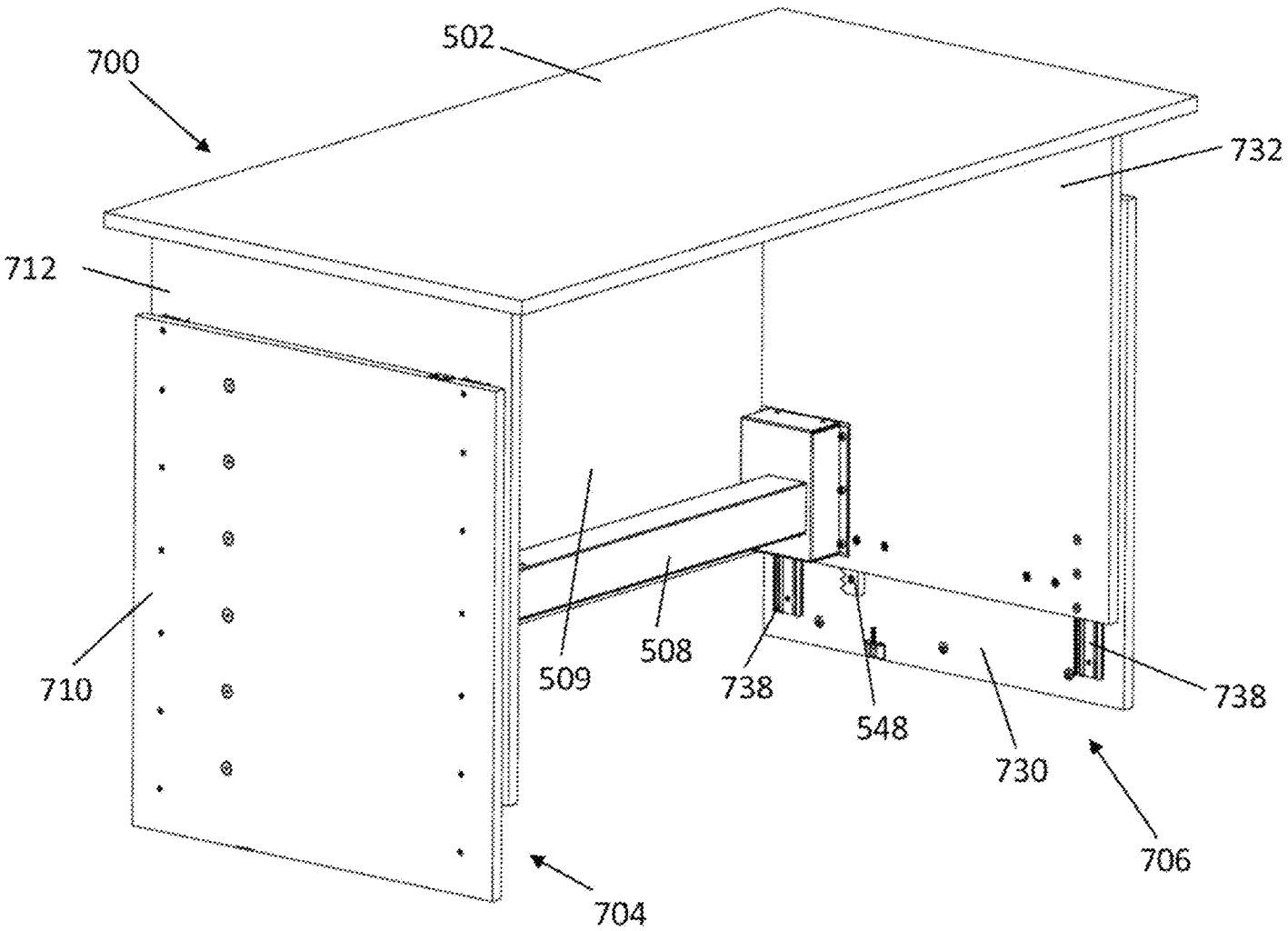
FIG. 21 is a perspective view of yet another embodiment of an electric adjustable height table, which includes leg assemblies with mobile leg members positioned on the interior of stationary leg members.
Figure 22:
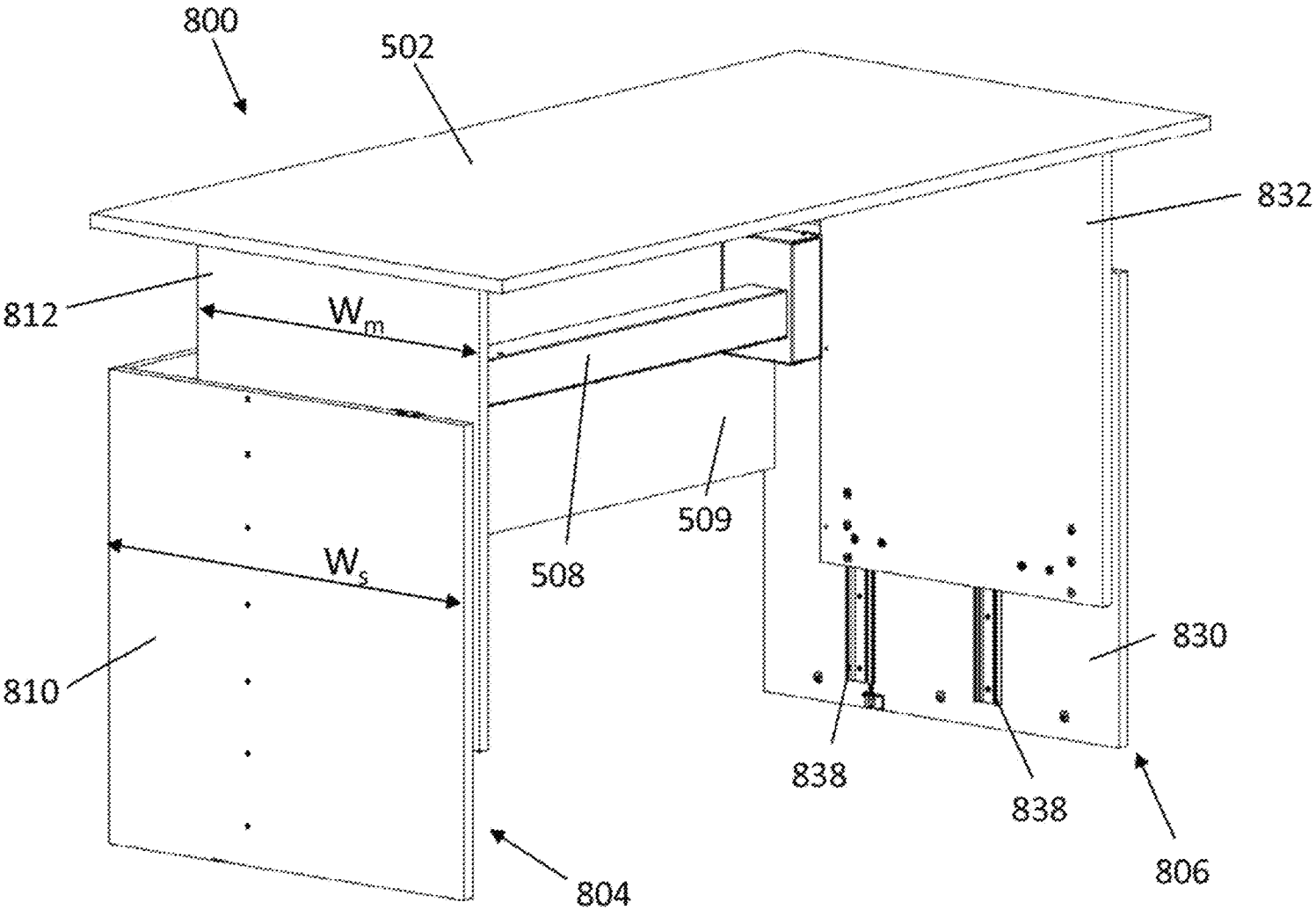
FIG. 22 is a perspective view of still another embodiment of an electric adjustable height table, which includes leg assemblies with mobile leg members positioned on the interior of stationary leg members.
Figures 23, 24:
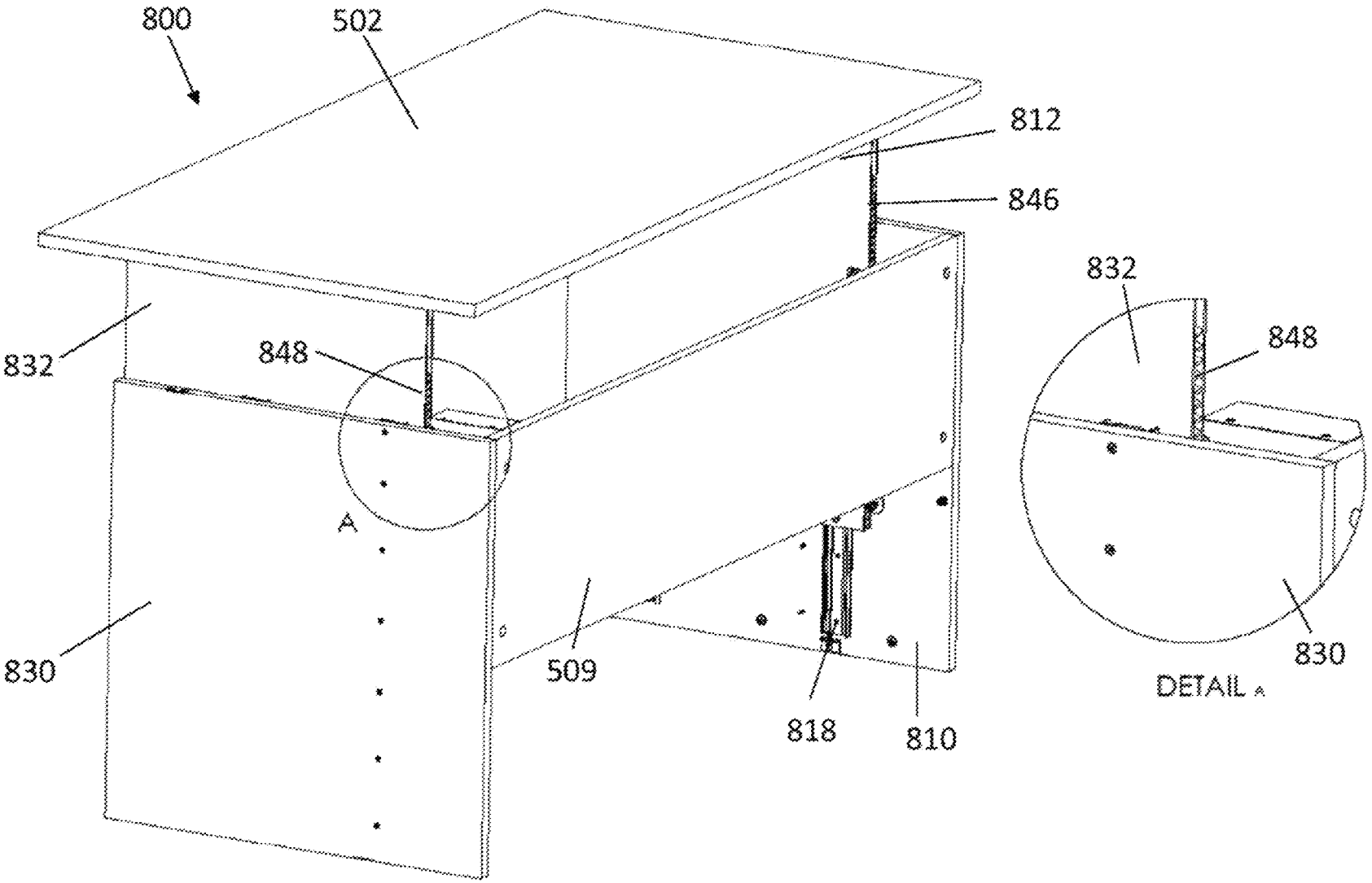
FIG. 23 is another perspective view of the electric adjustable height table in FIG. 22.
FIG. 24 is a detail view of the electric adjustable height table in FIG. 22 taken from Section A in FIG. 23.
Figure 25:
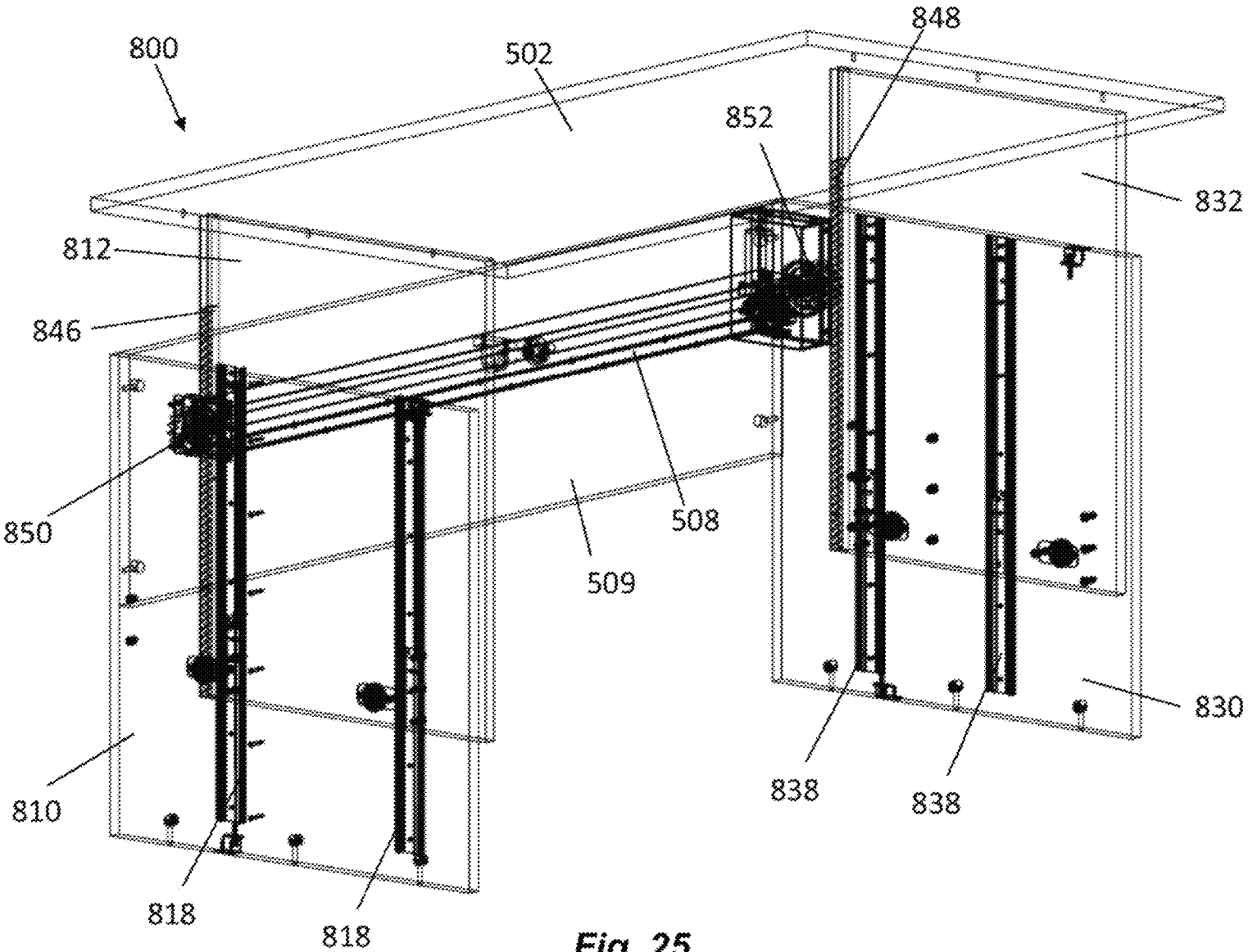
FIG. 25 is a perspective view of the electric adjustable height table in FIG. 22 with the leg members shown in transparent form.

FIG. 21 illustrates another embodiment of an electric adjustable height table 700, which includes table top 502 supported by a base assembly including first leg assembly 704 and second leg assembly 706. First leg assembly 704 includes first stationary leg member 710 coupled to first mobile leg member 712. Second leg assembly 706 includes second stationary leg member 730 and second mobile leg member 732. In this embodiment, first and second stationary leg members 710 and 730 are positioned on the exterior of first and second mobile leg members 712 and 732, with housing 508 extending between first and second mobile leg members 712 and 732. An electric motor and other electric components may be disposed within housing 508. The electric motor may be configured to raise and lower table top 502 between the raised and lowered positions by lifting and lowering mobile leg members 712 and 732, along with housing 508. In one embodiment, rack and pinion arrangements may be used to lift and lower the mobile leg members. For example, a rack may be secured to first stationary leg member 710 and rack 548 may be secured to second stationary leg member 730. Pinions configured to rotate along each of the racks may be secured to ends of an axle disposed within housing 508, such that the axle and pinions move vertically with vertical movement of mobile leg members 712 and 732.

Referring still to FIG. 21, table 700 may include linear motion systems. For example, one or more components of a first linear motion system may be secured between first stationary leg member 710 and first mobile leg member 712 in a first leg space. Similarly, one or more components, including components 738, of a second linear motion system may be secured between second stationary leg member 730 and second mobile leg member 732. The first and second linear motion systems enable first and second mobile leg members 712 and 732 to move in a vertical direction relative to first and second stationary leg members 710 and 730. The first and second linear motion systems may be formed of rails, drawer slides, linear glides, glides, rollers, racks and gears, custom sliders, or any other device configured to provide a reduced friction and smooth sliding motion between the mobile and stationary leg members. Except as otherwise described, table 700 includes the same features and functions described in connection with table 500 as noted with like reference numerals.

FIGS. 22-25 illustrate another embodiment of an electric adjustable height table 800, which includes table top 502 supported by a base assembly including first leg assembly 804 and second leg assembly 806. First leg assembly 804 includes first stationary leg member 810 coupled to first mobile leg member 812. Second leg assembly 806 includes second stationary leg member 830 and second mobile leg member 832. In this embodiment, first and second stationary leg members 810 and 830 are positioned on the exterior of first and second mobile leg members 812 and 832. Mobile leg members 812 and 832 each have a width $W_m$ that is less than a width $W_s$ of each of the stationary leg members 810 and 830. The proximal ends of the stationary leg members 810 and 830 may be generally aligned with the proximal ends of the mobile leg members 812 and 832, respectively. Greater width $W_s$ enables the distal ends of the stationary leg members 810 and 830 to extend beyond the distal ends of the mobile leg members 812 and 832, respectively.

With reference still to FIGS. 22-25, each end of housing 508 may be secured to a portion of one of the stationary leg members 810 and 830 near the distal end of the stationary leg member 810 and 830 and beyond the distal end of the adjacent mobile leg member 812 and 832, respectively. An electric motor and other electric components may be disposed within housing 508. The electric motor may be configured to raise and lower table top 502 between the raised and lowered positions by lifting and lowering mobile leg members 812 and 832, while housing 508 remains stationary with stationary leg members 810 and 830. In one embodiment, rack and pinion arrangements may be used to lift and lower the mobile leg members. For example, electric adjustable height table 800 may further include two pinions, including first pinion 850 and a second pinion 852. In certain embodiments, first and second pinions 850 and 852 may each be secured to an end of an axle extending through housing 508. In other embodiments, first and second pinions 850 and 852 may be secured to separate axle members configured to rotate each of the pinions. The first pinion 850 may engage and rotate along first rack 846, which is secured to first mobile leg member 812. Similarly, the second pinion 852 may engage and rotate along second rack 848, which is secured to second mobile leg member 832. In certain embodiments, first and second racks 846 and 848 are each secured to the distal end of first and second mobile leg members 812 and 832, respectively. In other embodiments, first and second racks 846 and 848 are each secured to an outside surface of first and second mobile leg members 812 and 832 such that first and second racks 846 and 848 are disposed within the first and second leg spaces, respectively. In still other embodiments, first and second racks 846 and 848 are each secured within a recess formed in first and second mobile leg members 812 and 832. The electric motor, which may be disposed within housing 508, may be configured to cause rotation of first and second pinions 850 and 852. First and second pinions 850 and 852 rotate in place, thereby causing lifting or lowering of first and second racks 846 and 848, along with mobile leg members 812 and 832, respectively.

Referring again to FIGS. 22-25, one or more components 818 of a first linear motion system may be secured between first stationary leg member 810 and first mobile leg member 812 in a first leg space. Similarly, one or more components, including components 838, of a second linear motion system may be secured between second stationary leg member 830 and second mobile leg member 832. The first and second linear motion systems enable first and second mobile leg members 812 and 832 to move in a vertical direction relative to first and second stationary leg members 810 and 830. The first and second linear motion systems may be formed of rails, drawer slides, linear glides, glides, rollers, racks and gears, custom sliders, or any other device configured to provide a reduced friction and smooth sliding motion between the mobile and stationary leg members. Except as otherwise described, table 800 includes the same features and functions described in connection with table 500 as noted with like reference numerals.

Figure 26:
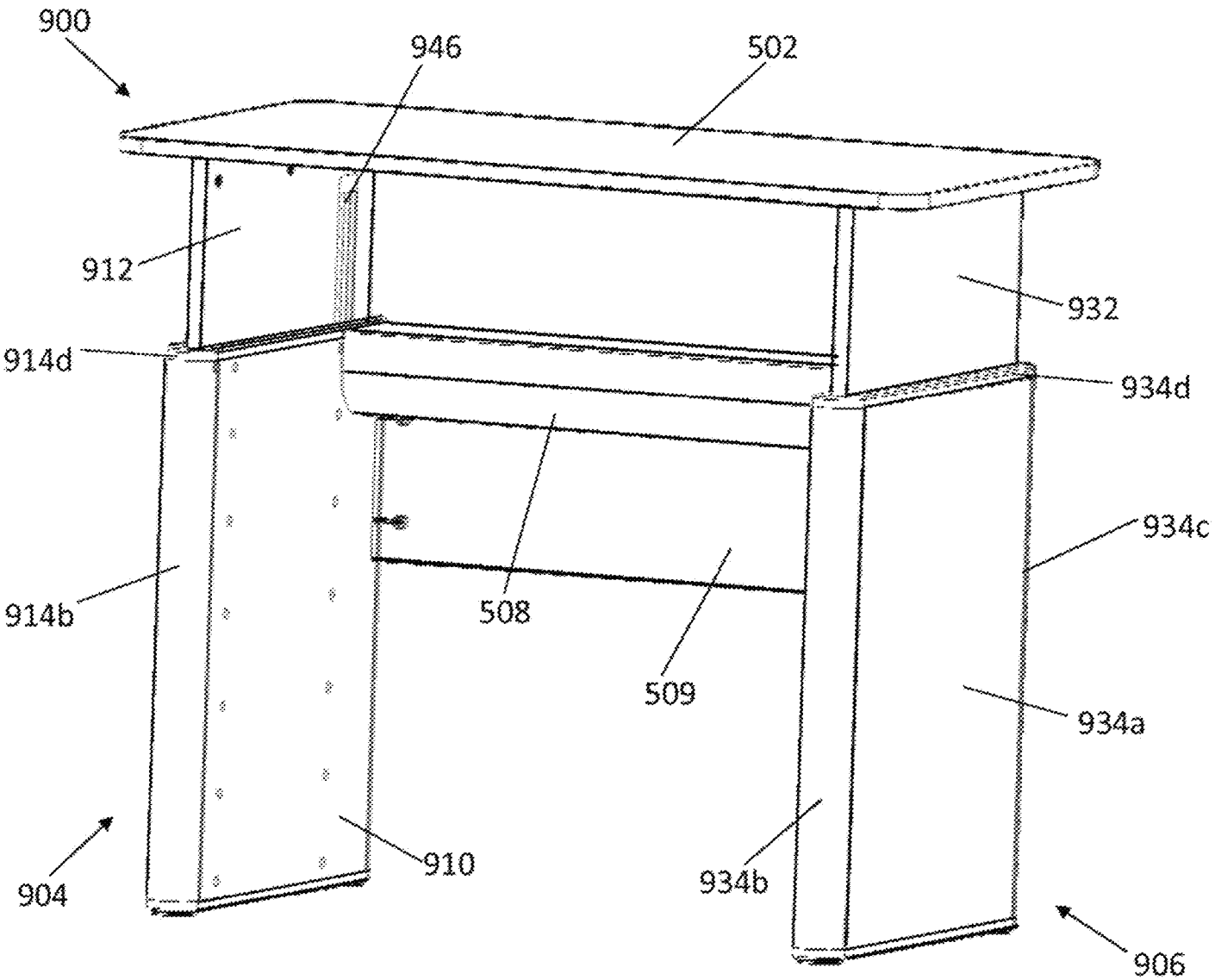
FIG. 26 is a perspective view of yet another embodiment of an electric adjustable height table, which includes leg assemblies each with a mobile leg member, a stationary leg member, and a non-load bearing cover.
Figure 27:
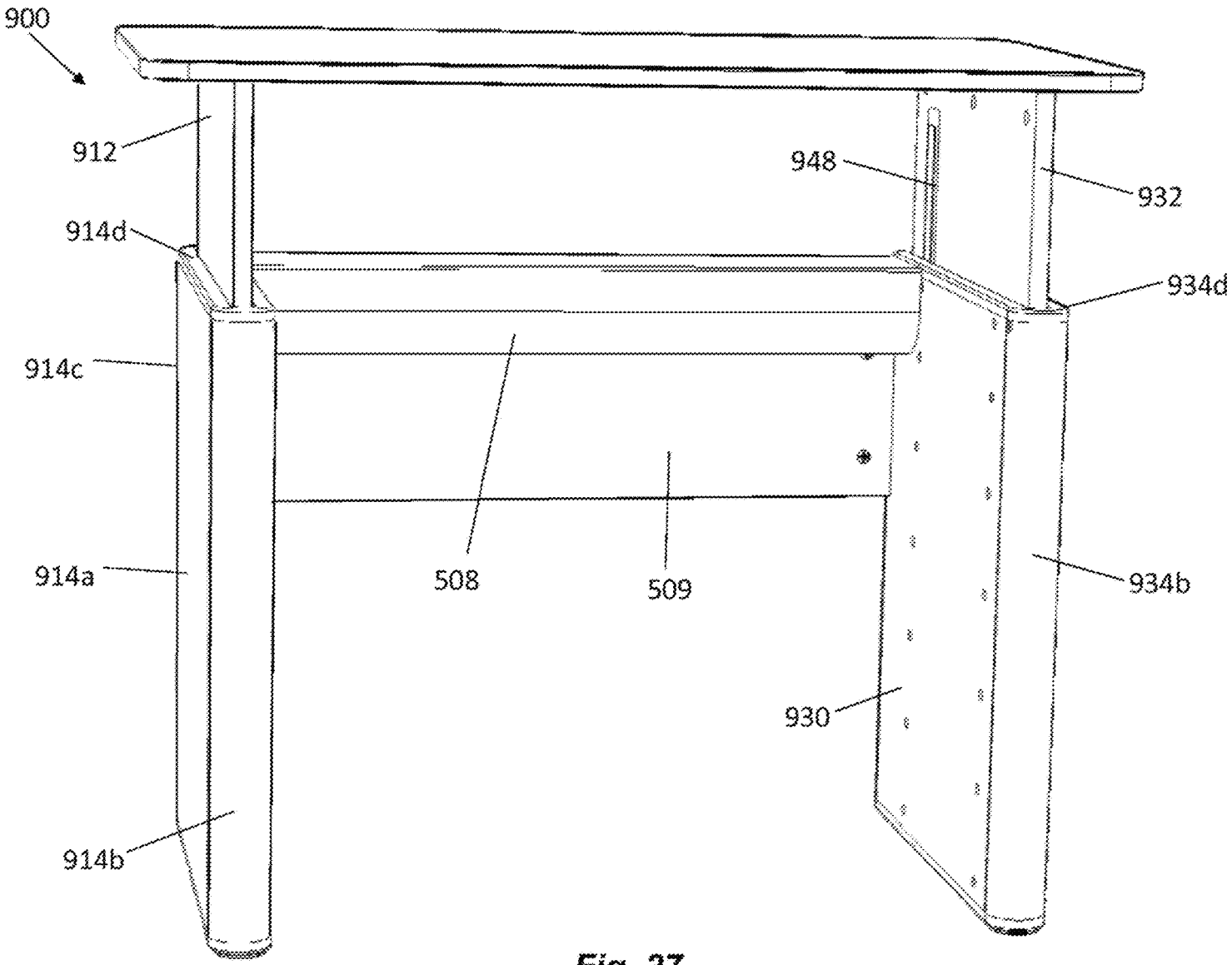
FIG. 27 is another perspective view of the electric adjustable height table in FIG. 26.

FIGS. 26-27 illustrate adjustable height table 900, which is yet another embodiment of an electric adjustable height table exemplifying the principles of the present invention. Table 900 includes table top 502 supported by a base assembly including first leg assembly 904 and second leg assembly 906. First leg assembly 904 includes first stationary leg member 910 coupled to a first mobile leg member 912 with cover 914 at least partially enclosing the parallel sliding connection between first stationary leg member 910 and first mobile leg member 912. A first linear motion system may be secured between first stationary leg member 910 and first mobile leg member 912. Similarly, second leg assembly 906 includes second stationary leg member 930 coupled to second mobile leg member 932 with cover 934 at least partially enclosing the parallel sliding connection between second stationary leg member 930 and second mobile leg member 932. A second linear motion system may be secured between second stationary leg member 930 and second mobile leg member 932. The first and second linear motion systems may include rails, drawer slides, linear glides, glides, rollers, racks and gears, custom sliders, or any other device configured to provide a reduced friction and smooth sliding motion between the mobile and stationary leg members.

Covers 914 and 934 are configured to cover the connection between the mobile and stationary leg members without bearing any substantial load from the weight of table 900 or any items positioned on tabletop 502. Instead, the load is transmitted by mobile leg members 912 and 932 through the first and second linear motion systems to stationary leg members 910 and 930, respectively. In other words, covers 914 and 934 are non-load bearing covers. While independent from the structure of table 900, covers 914 and 934 prevent pinch points and improve the aesthetics of table 900.

In one embodiment, cover 914 includes side portion 914*a*, end portions 914*b* and 914*c*, and top portion 914*d*, and cover 934 includes side portion 934*a*, end portions 934*b* and 934*c*, and top portion 934*d*. Top portions 914*d* and 934*d* of the covers may each include an opening configured to allow the mobile leg members 912 and 932 to slide therethrough as the height position of table 900 is adjusted between the lowered position and the raised position. Covers 914 and 934 may substantially or completely cover the stationary leg members 910, 930 and the mobile leg members 912, 932 in the lowered position. In one embodiment, the covers 914 and 934 substantially or completely cover stationary leg members 910, 930 while only enclosing a portion of mobile leg members 912, 932 in the raised position shown in FIG. 26. In other embodiments, the covers 914 and 934 may substantially or completely enclose all of the leg members in the raised position. For example, the covers 914 and 934 may expand or extend to completely enclose the mobile leg members 912, 932 in the raised position. Except as otherwise described, electric height adjustable table 900 includes the same features and functions described in connection with table 500 as noted with like reference numerals.

Figure 28:
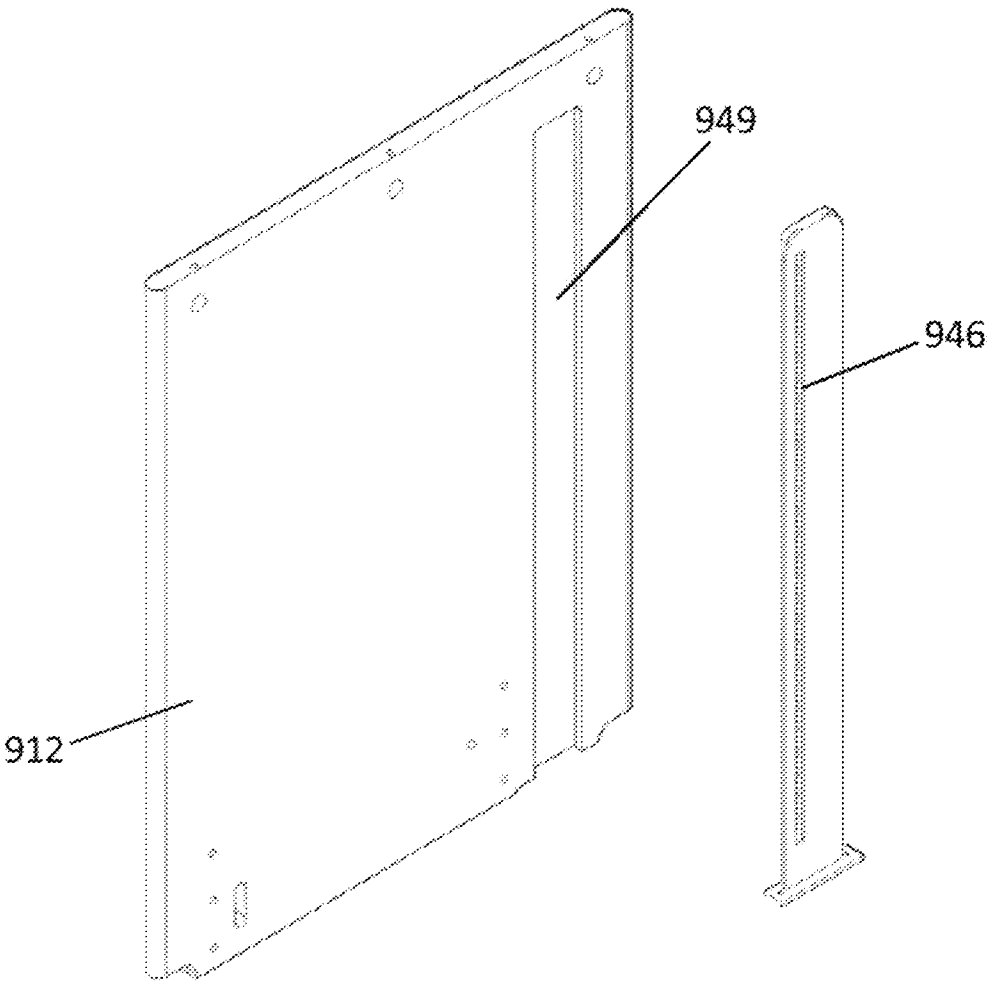
FIG. 28 is a perspective view of a mobile leg member and a rack member of the electric adjustable height table in FIG. 26.

With reference to FIGS. 26-28, electric adjustable height table 900 may further include two pinions. In one embodiment, each pinion is secured to an end of an axle extending through housing 508, with a motor configured to cause rotation of the axle. In another embodiment, the table includes two motors, each configured to cause rotation of one of the pinions. A first pinion may engage and rotate along first rack 946 secured to first mobile leg member 912, and a second pinion may engage and rotate along second rack 948 secured to second mobile leg member 932. In one embodiment, first mobile leg member 912 includes recess 949 configured to receive first rack 946, and second mobile leg member 932 includes a recess configured to receive second rack 948. In this embodiment, the first and second pinions are disposed beyond the first and second leg spaces in order to engage first and second racks 946 and 948, which are secured within the recesses of mobile leg members 912 and 932.

Figure 30:
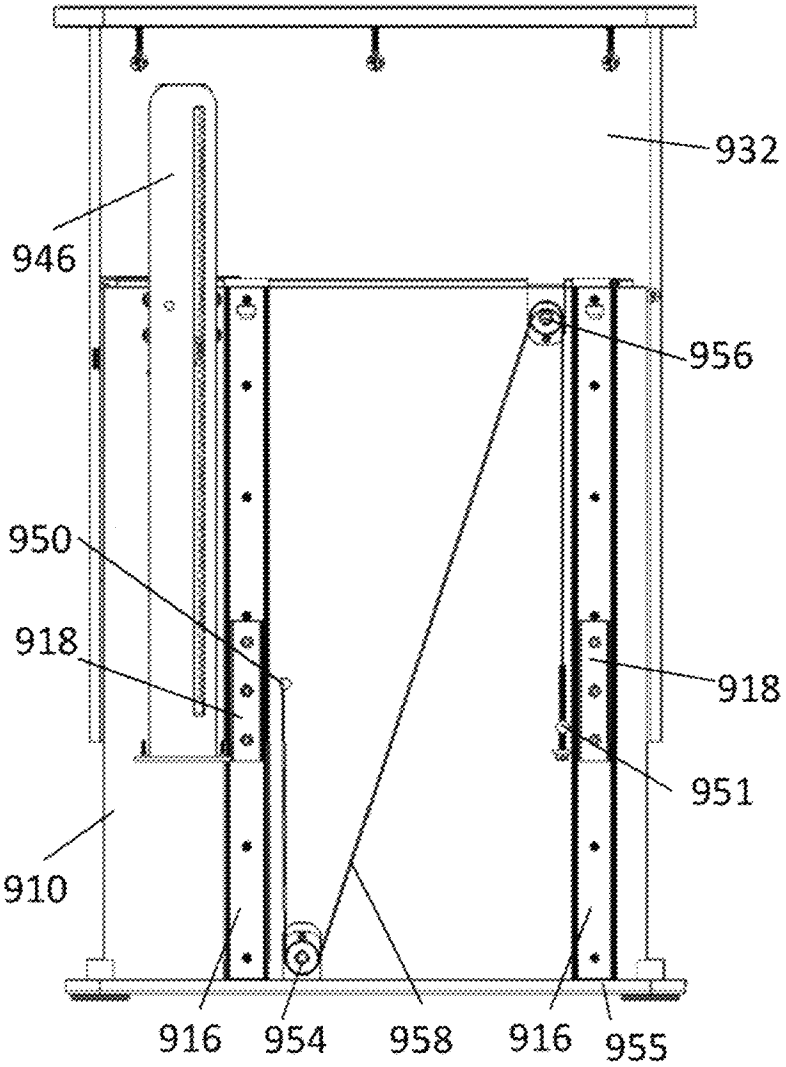
FIG. 30 is a left side view of the electric adjustable height table in FIG. 26 with the non-load bearing cover and a mobile leg member removed.
Figure 29:
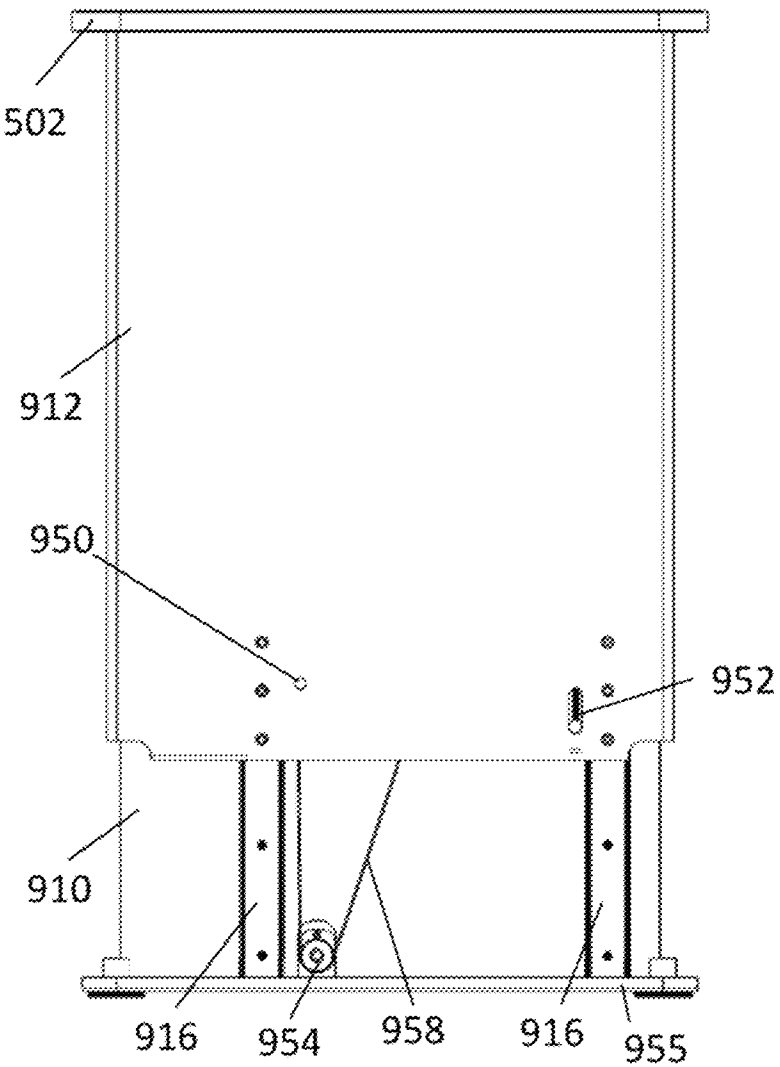
FIG. 29 is a left side view of the electric adjustable height table in FIG. 26 with the non-load bearing cover removed.

FIG. 29 illustrates table 900 without cover 914. FIG. 30 illustrates table 900 without cover 914 and without first mobile leg member 912. Table 900 may further include a synchronizing system configured to stabilize the sliding of the vertical support structures to ensure that table top 502 and the mobile leg members remain in a level orientation in relation to the stationary leg members during adjustment of the table's height position. In this embodiment, the synchronizing system includes a rope or cord extending from a first end secured to a connection point on one side of first mobile leg member 912 to a second end secured to a connection point on the opposite side of first mobile leg member 912. For example, anchor 950 may be secured to mobile leg member 912 and anchor 951 may slidingly engage vertical slot 952 of first mobile leg member 912. Pulley 954 may be secured to a base member 955, which may be secured to or integrally formed with first stationary leg member 910. Pulley 956 may be secured to first stationary leg member 910 or to top portion 914*d* of cover 914. A portion of flexible line 958 (e.g., an end) may be secured to anchor 950, and another portion of flexible line 958 (e.g., an end) may be secured to anchor 951. Flexible line 958 may extend from anchor 950, around pulley 954, around pulley 956, and to anchor 951. Flexible line 958 may be formed of any flexible elongated structure, such as a rope or cable. In one embodiment, anchor 950 may secure a portion of flexible line 958 to first mobile leg member 912 near rack 946, while anchor 951 may secure another portion of flexible line 958 to the opposite side of first mobile leg member 912. As the pinion rotates along rack 946 to cause first mobile leg member 912 to move in an upward direction relative to first stationary leg member 910, anchor 950 moves upward and pulls the portion of flexible line 958 secured to anchor 950 upward. This movement of flexible line 958 pulls anchor 951 upward within vertical slot 952 until anchor 951 engages the upper surface of vertical slot 952. The engagement of the upper surface of vertical slot 952 by anchor 951 provides an upward force on first mobile leg member 912 at a distance separated from rack 946. In this way, the synchronization system helps to maintain the level orientation of table top 502 and mobile leg member 912 during height adjustment. The same arrangement of pulleys, anchors, and flexible line may be incorporated in the second mobile and stationary leg members.

The synchronizing system of the adjustable height table disclosed herein may be formed of any components configured to distribute or apply an upward force at a distance, i.e., distance along the width of the mobile leg member, away from the rack and pinion combination that is powered by a motor or counterbalance assembly.

Figure 31:
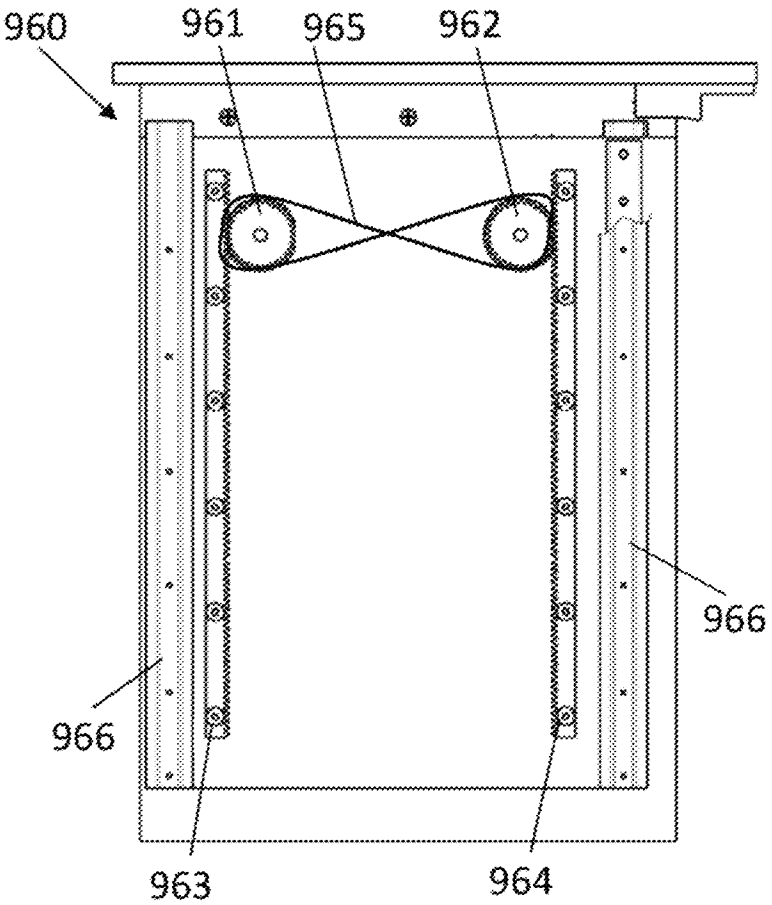
FIG. 31 is a cutaway side view of another embodiment of an adjustable height table including a synchronizing system having a belt.

For example, the table 960 shown in FIG. 31 is another embodiment of the electric adjustable height table including a synchronization system disclosed herein. Except as otherwise noted, table 960 includes the same components and features as table 500. The illustrated first leg assembly of table 960 includes two pinions 961 and 962 configured to engage and rotate along racks 963 and 964, respectively. With reference still to FIG. 31, the synchronization system of table 960 includes belt 965, which engages both pinions 961 and 962 such that rotation of one pinion rotates the other. In one embodiment, table 960 includes one motor configured to rotate pinion 961 along rack 963, resulting in an upward force applied to the mobile leg member (not shown) at the location of pinion 961. Rotation of pinion 961 rotates belt 965, which in turn rotates pinion 962 to apply an upward force to the mobile leg member at the location of pinion 962. In this way, the synchronization system applies an upward force on the mobile leg member at a distance from the point at which the motorized pinion applies the upward force, thereby ensuring that the mobile leg member and the table top remain level during height adjustment. The synchronization system of the adjustable height table base assembly may include a flexible line, such as a rope, cable, or belt.

Alternatively, table 960 may include one motor configured to rotate pinion 962 along rack 964, and belt 965 rotates pinion 961 along rack 963 in order to apply an upward force on the mobile leg member at a distance from motorized pinion 962. In yet another embodiment, table 960 may include two motors each configured to rotate one of pinions 961 and 962 along racks 963 and 964, respectively. In this embodiment, belt 965 may ensure that the rotation of pinions 961 and 962 remains synchronized. The first leg assembly of table 960 may also include two linear motion systems 966. Both rack and pinion pairs may be positioned between the linear motion systems 966. Table 960 may include a second leg assembly including the same components as the illustrated first leg assembly. Alternatively, the second leg assembly of table 960 may include a different configuration.

Figure 32:
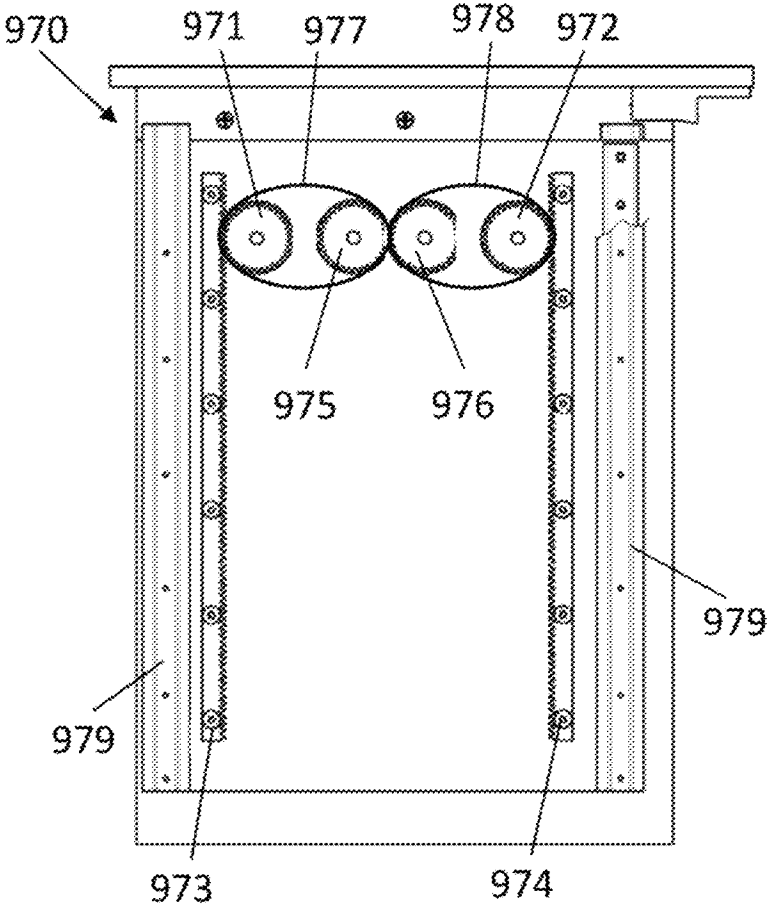
FIG. 32 is a cutaway side view of yet another embodiment of an adjustable height table including a synchronizing system including two belts.

FIG. 32 illustrates table 970, which is another embodiment of the electric adjustable height table including a synchronization system disclosed herein. Except as otherwise noted, table 970 includes the same components and features as table 500. The illustrated first leg assembly of table 970 includes two pinions 971 and 972 configured to engage and rotate along racks 973 and 974, respectively. The synchronization system of table 970 includes gears 975 and 976 and belts 977 and 978. Belt 977 is configured to rotate gear 975 when pinion 971 rotates. Likewise, belt 978 is configured to rotate gear 975 when pinion 972 rotates. Gear 975 and gear 976 are configured to engage one another such that rotation of one gear rotates the other. Table 970 may include one, two, three, or four motors each configured to rotate one of the pinions or one of the gears. The synchronization system rotates all gears and pinions when any of the gears or pinions are rotated by a motor. In this way, the synchronization system applies an upward force on the mobile leg member at a distance from the point at which the motorized pinion(s) and/or the motorized gear(s) apply an upward force, thereby ensuring that the mobile leg member and the table top remain level during height adjustment. Alternatively, in embodiments including separate motors causing rotation of both pinions, the synchronization system of table 970 ensures that the rotation of pinions 971 and 972 remain synchronized. The first leg assembly of table 970 may also include two linear motion systems 979, with the pinions, racks, and gears all positioned between the linear motion systems 979. Table 970 may include a second leg assembly including the same components as the illustrated first leg assembly. Alternatively, the second leg assembly of table 970 may include a difference configuration.

Figure 33:
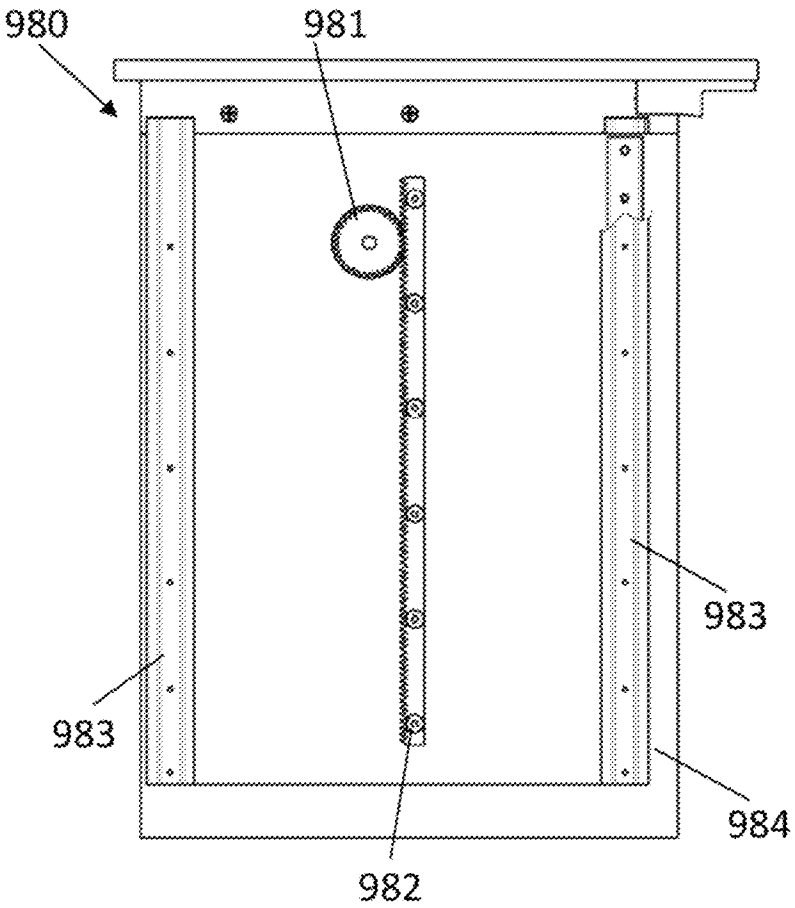
FIG. 33 is a cutaway side view of another embodiment of an adjustable height table including a rack and pinion positioned in a central portion of the leg assembly.

With reference to FIG. 33, the position of the rack and pinion assembly in the leg assemblies of the adjustable height table may provide the same effect as the synchronizing system. Table 980 is another embodiment of the electric adjustable height table disclosed herein. Except as otherwise noted, table 980 may include the same components and features as table 500. FIG. 33 illustrates a portion of the first leg assembly of table 980, which includes one pinion 981 configured to engage and rotate along rack 982. The first leg assembly may also include two linear motion systems 983, with pinion 981 and rack 982 disposed therebetween. Pinion 981 and rack 982 are positioned within a central portion along the width of the first mobile leg member (not shown) and the first stationary leg member 984. The centrally located pinion and rack apply an upward force on a central portion of the mobile leg member, which equalizes the load across the width of the mobile leg member, thereby assisting to maintain the mobile leg member and the table top in a level position as the table's height position is adjusted.

In some embodiments, the adjustable height table may include three or more leg assemblies. For example, an electric adjustable height table of the present invention may include three leg assemblies, each including a stationary flat vertical support structure and a mobile flat vertical support structure. In this embodiment, the electric adjustable height table may include three motors (i.e., one motor configured to adjust each leg assembly), two motors (i.e., one motor configured to adjust a first leg assembly and a second motor configured to adjust the second and third leg assemblies), or one motor (i.e., one motor configured to adjust all three leg assemblies). In another example, a counterbalance adjustable height table of the present invention may include three leg assemblies.

In certain embodiments, the adjustable height table base assembly disclosed herein may be configured for attachment to a variety of table tops. In other embodiments, a kit includes the base assembly disclosed herein and a table top configured for attachment to the base assembly.

The features shown and described in the various embodiments of the adjustable height table disclosed herein may be used interchangeably. For example, but not by way of limitation, the leg assembly configurations shown and described in connection with electric adjustable height tables 700 and 800 may each be used in a counterbalance adjustable height table. Also, counterbalance adjustable height table 10 may further include a synchronizing system (e.g., a flexible line similar to line 562) configured to ensure that table top 50 remains level during height adjustment.

Conventional adjustable height tables include telescoping legs. As used herein, "telescoping legs" are legs formed by two or more telescoping leg members with the smaller leg members nesting within hollow spaces of the larger leg members when retracted; all telescoping leg members are load bearing and provide structural support for the table. The telescoping members are typically enclosed tubes of various shapes. The tubes are made of a variety of materials, including metal and/or plastic. In contrast, certain embodiments of the adjustable height table disclosed herein include stationary and mobile leg members formed of flat vertical support structures configured to slide parallel to one another. The flat vertical support structure configuration permits use of nontraditional materials, such as veneer and laminate, or softer materials like PET or mesh, as opposed to typical steel tube construction. The flat vertical support configuration also provides aesthetic benefits, increases privacy and ease of use, and reduces manufacturing costs.

All telescoping members of the telescoping legs in conventional adjustable height tables provide structural support for the table in order to bear the load imposed by the weight of the upper table components and any objects supported by the table top. In contrast, certain embodiments of the adjustable height table disclosed herein include flat vertical support structures that are load bearing and slide parallel to one another with a non-load bearing cosmetic cover. In certain embodiments, the non-load bearing cosmetic cover may be a telescoping cover. The vertical support structures support a load from the table top and any objects supported by the table top in the same direction in which the linear motion systems allow sliding.

Additionally, certain embodiments of the adjustable height tables disclosed herein include parallel sliding vertical support structures with substantially greater widths than the widths of conventional telescoping table legs. The synchronizing system disclosed herein stabilizes the leg assemblies against non-level sliding (i.e., rocking) during extension and retraction in response to downward forces (e.g., gravitational forces) applied at a distance from the driving mechanism of the leg assembly's extension and retraction.

"Bridge" as used herein means any structure or combination of structures that interconnects two or more leg assemblies of a table's base assembly.

"Twist" as used herein means rotational movement of an end of a torsion spring in either direction. In other words, "twist" means "twist" and "untwist."

"Rotationally secured" as used herein means secured to another component (e.g., an axle) such that rotation of the other component rotates the named component (e.g., a gear). In other words, there is no relative rotation between the two components.

"Rotationally coupled" as used herein means directly or indirectly connected to another component such that rotation of the other component rotates the named component. In other words, there is no relative rotation between the two components, but there may or may not be additional components linking the two described components.

Except as otherwise described or illustrated, each of the components in this device may be formed of aluminum, steel, another metal, plastic, or any other durable, natural or synthetic material. Each device described in this disclosure may include any combination of the described components, features, and/or functions of each of the individual device embodiments. Each method described in this disclosure may include any combination of the described steps in any order, including the absence of certain described steps and combinations of steps used in separate embodiments. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. An adjustable height table base assembly, comprising:

two or more non-telescoping leg assemblies each including a mobile leg member, a stationary leg member positioned adjacent to the mobile leg member, and a linear motion system positioned in between the mobile leg member and the stationary leg member; wherein the mobile leg members and the stationary leg members are each a flat vertical support structure; wherein the mobile leg members are configured to be secured to and support a table top; wherein each linear motion system includes a first portion secured to the mobile leg member and a second portion secured to the stationary leg member; wherein the first portions engage the second portions to permit vertical parallel motion of the mobile leg members in relation to the stationary leg members for extending and retracting the leg assemblies to adjust the height position of the mobile leg members;

a bridge extending between and interconnecting the two or more leg assemblies;

a synchronizing system configured to maintain a level orientation of each mobile leg member during adjustment of the height position of the mobile leg members; and a counterbalance mechanism configured to apply an equalized counterbalance lifting force as a height position of the mobile leg members is adjusted; the counterbalance mechanism comprising:

a torsion spring extending between the two or more leg assemblies; and an equalizing assembly engaging a first end of the torsion spring; wherein the equalizing assembly is configured to twist the torsion spring as with adjustment of the height position; wherein the equalizing assembly is configured to translate a variable torque exerted by the torsion spring on the equalizing assembly into the equalized counterbalance lifting force exerted by the equalizing assembly on the linear motion systems.

2. The adjustable height table base assembly of claim 1, wherein each of the two or more leg assemblies further includes a non-load bearing cover enclosing at least a portion of the mobile leg member and at least a portion of the stationary leg member.

3. The adjustable height table base assembly of claim 1, wherein each linear motion system is comprised of rails.

4. The adjustable height table base assembly of claim 1, wherein each linear motion system is comprised of sliding or rolling members.

5. The adjustable height table base assembly of claim 1, wherein each linear motion system is comprised of drawer slides.

6. The adjustable height table base assembly of claim 1, wherein each linear motion system is comprised of glides.

7. The adjustable height table base assembly of claim 1, wherein each linear motion system is comprised of linear glides.

8. The adjustable height table base assembly of claim 1, wherein each linear motion system is comprised of rollers.

9. The adjustable height table base assembly of claim 1, wherein each linear motion system is comprised of custom sliders.

10. The adjustable height table base assembly of claim 1, wherein each linear motion system is comprised of racks and gears.

11. The adjustable height table base assembly of claim 1, wherein the bridge includes an axle and a housing each extending between the two or more leg assemblies; wherein the axle is disposed within the housing; and wherein the adjustable height table base assembly further comprises two rack and pinion assemblies each including a pinion secured to the axle and a rack secured to either the mobile leg member or the stationary leg member of one of the leg assemblies.

12. The adjustable height table base assembly of claim 1, further comprising an electric lift system providing a fully motorized lift.

13. The adjustable height table base assembly of claim 12, further comprising a single electric motor.

14. The adjustable height table base assembly of claim 12, further comprising two electric motors.

15. A kit comprising: the adjustable height table base assembly of claim 1 and a table top configured for attachment to the mobile leg members.

16. An adjustable height table comprising: the adjustable height table base assembly of claim 1, and a table top secured to and supported by the mobile leg members, wherein the table top has a height position that is adjustable between a lowered position and a raised position.

17. An adjustable height table base assembly, comprising:

two or more leg assemblies each including a mobile leg member, a stationary leg member positioned adjacent to the mobile leg member, and a linear motion system positioned in between the mobile leg member and the stationary leg member; wherein the mobile leg members and the stationary leg members are each a flat vertical support structure; wherein the mobile leg members are configured to be secured to and support a table top; wherein each linear motion system is secured to the mobile leg member and the stationary leg member; wherein the linear motion systems permit vertical parallel motion such that the leg assemblies are configured to extend and retract to adjust the height position of the mobile leg members;

a counterbalance mechanism configured to apply an equalized counterbalance lifting force as a height position of the mobile leg members is adjusted; the counterbalance mechanism comprising:

an axle extending between the two or more leg assemblies;

two rack and pinion assemblies, wherein each pinion is rotationally secured to an end of the axle; wherein each pinion is configured to engage and rotate on one of the racks;

a torsion spring disposed around a central portion of the axle; and an equalizing assembly engaging the axle and a first end of the torsion spring; wherein the equalizing assembly is configured to twist the torsion spring as the axle rotates with adjustment of the height position; wherein the equalizing assembly is configured to translate a variable torque exerted by the torsion spring on the equalizing assembly into the equalized counterbalance lifting force exerted by the equalizing assembly on the two rack and pinion assemblies.

18. The adjustable height table base assembly of claim 17, wherein each of the two or more leg assemblies further includes a non-load bearing cover enclosing at least a portion of the mobile leg member and at least a portion of the stationary leg member.

* * * * *